US011879460B2

(12) United States Patent
Ives

(10) Patent No.: US 11,879,460 B2
(45) **Date of Patent: *Jan. 23, 2024**

(54) COMPRESSOR MODULATION SYSTEM WITH MULTI-WAY VALVE

(71) Applicant: Copeland LP, Sidney, OH (US)

(72) Inventor: Camden L. Ives, Folsom, CA (US)

(73) Assignee: Copeland LP, Sidney, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/980,798

(22) Filed: Nov. 4, 2022

(65) Prior Publication Data

US 2023/0055642 A1 Feb. 23, 2023

Related U.S. Application Data

(63) Continuation of application No. 17/388,923, filed on Jul. 29, 2021, now Pat. No. 11,655,813.

(51) Int. Cl.
*F03C 2/00* (2006.01)
*F03C 4/00* (2006.01)
(Continued)

(52) U.S. Cl.
CPC ..... *F04C 2/04* (2013.01); *F04C 15/0019* (2013.01); *F04C 29/124* (2013.01); *F04C 2270/58* (2013.01)

(58) Field of Classification Search
CPC ..... F04C 18/0215; F04C 18/0253; F04C 18/0261; F04C 2/04; F04C 15/0019; F04C 23/008; F04C 27/005; F04C 28/18; F04C 28/26; F04C 28/265; F04C 29/0021; F04C 29/12; F04C 29/124; F04C 2270/58; F01C 1/0215; F01C 1/0253; F01C 2021/1643; F01C 2021/165
See application file for complete search history.

(56) References Cited

U.S. PATENT DOCUMENTS 3,303,988 A 2/1967 Weatherhead
4,058,988 A 11/1977 Shaw
(Continued)

FOREIGN PATENT DOCUMENTS

AU 2002301023 B2 6/2005
CN 1137614 A 12/1996
(Continued)

OTHER PUBLICATIONS

Office Action dated Mar. 9, 2023, in U.S. Appl. No. 17/835,048.
(Continued)

*Primary Examiner* — Theresa Trieu
(74) *Attorney, Agent, or Firm* — Harness, Dickey & Pierce, P.L.C.

(57) ABSTRACT

A compressor may include first and second scrolls, an axial biasing chamber, and a control valve. The second scroll includes an outer port and an inner port. The outer and inner ports may be open to respective intermediate-pressure compression pockets. The control valve may be in fluid communication with the inner port, the outer port, and the axial biasing chamber. Movement of the control valve into the first position allows fluid communication between the inner port and the axial biasing chamber. Movement of the control valve into the second position allows fluid communication between the outer port and the axial biasing chamber.

22 Claims, 14 Drawing Sheets

(51) Int. Cl.

| | |
|---|---|
| ***F04C 2/00*** | (2006.01) |
| ***F04C 18/00*** | (2006.01) |
| ***F04C 2/04*** | (2006.01) |
| ***F04C 29/12*** | (2006.01) |
| ***F04C 15/00*** | (2006.01) |

(56) References Cited

U.S. PATENT DOCUMENTS

| | | | |
|---|---|---|---|
| 4,216,661 | A | 8/1980 | Tojo et al. |
| 4,382,370 | A | 5/1983 | Suefuji et al. |
| 4,383,805 | A | 5/1983 | Teegarden et al. |
| 4,389,171 | A | 6/1983 | Eber et al. |
| 4,466,784 | A | 8/1984 | Hiraga |
| 4,475,360 | A | 10/1984 | Suefuji et al. |
| 4,475,875 | A | 10/1984 | Sugimoto et al. |
| 4,496,296 | A | 1/1985 | Arai et al. |
| 4,497,615 | A | 2/1985 | Griffith |
| 4,508,491 | A | 4/1985 | Schaefer |
| 4,545,742 | A | 10/1985 | Schaefer |
| 4,547,138 | A | 10/1985 | Mabe et al. |
| 4,552,518 | A | 11/1985 | Utter |
| 4,564,339 | A | 1/1986 | Nakamura et al. |
| 4,580,949 | A | 4/1986 | Maruyama et al. |
| 4,609,329 | A | 9/1986 | Pillis et al. |
| 4,650,405 | A | 3/1987 | Iwanami et al. |
| 4,696,630 | A | 9/1987 | Sakata et al. |
| 4,727,725 | A | 3/1988 | Nagata et al. |
| 4,772,188 | A | 9/1988 | Kimura et al. |
| 4,774,816 | A | 10/1988 | Uchikawa et al. |
| 4,818,195 | A | 4/1989 | Murayama et al. |
| 4,824,344 | A | 4/1989 | Kimura et al. |
| 4,838,773 | A | 6/1989 | Noboru |
| 4,842,499 | A | 6/1989 | Nishida et al. |
| 4,846,633 | A | 7/1989 | Suzuki et al. |
| 4,877,382 | A | 10/1989 | Caillat et al. |
| 4,886,425 | A | 12/1989 | Itahana et al. |
| 4,886,433 | A | 12/1989 | Maier |
| 4,898,520 | A | 2/1990 | Nieter et al. |
| 4,927,339 | A | 5/1990 | Riffe et al. |
| 4,936,543 | A | 6/1990 | Kamibayasi |
| 4,940,395 | A | 7/1990 | Yamamoto et al. |
| 4,954,057 | A | 9/1990 | Caillat et al. |
| 4,990,071 | A | 2/1991 | Sugimoto |
| 4,997,349 | A | 3/1991 | Richardson, Jr. |
| 5,024,589 | A | 6/1991 | Jetzer et al. |
| 5,040,952 | A | 8/1991 | Inoue et al. |
| 5,040,958 | A | 8/1991 | Arata et al. |
| 5,055,010 | A | 10/1991 | Logan |
| 5,059,098 | A | 10/1991 | Suzuki et al. |
| 5,071,323 | A | 12/1991 | Sakashita et al. |
| 5,074,760 | A | 12/1991 | Hirooka et al. |
| 5,080,056 | A | 1/1992 | Kramer et al. |
| 5,085,565 | A | 2/1992 | Barito |
| 5,098,265 | A | 3/1992 | Machida et al. |
| 5,145,346 | A | 9/1992 | Iio et al. |
| 5,152,682 | A | 10/1992 | Morozumi et al. |
| RE34,148 | E | 12/1992 | Terauchi et al. |
| 5,169,294 | A | 12/1992 | Barito |
| 5,171,141 | A | 12/1992 | Morozumi et al. |
| 5,192,195 | A | 3/1993 | Iio et al. |
| 5,193,987 | A | 3/1993 | Iio et al. |
| 5,199,862 | A | 4/1993 | Kondo et al. |
| 5,213,489 | A | 5/1993 | Kawahara et al. |
| 5,240,389 | A | 8/1993 | Oikawa et al. |
| 5,253,489 | A | 10/1993 | Yoshii |
| 5,304,047 | A | 4/1994 | Shibamoto |
| 5,318,424 | A | 6/1994 | Bush et al. |
| 5,330,463 | A | 7/1994 | Hirano |
| 5,336,068 | A | 8/1994 | Sekiya et al. |
| 5,340,287 | A | 8/1994 | Kawahara et al. |
| 5,356,271 | A | 10/1994 | Miura et al. |
| 5,395,224 | A | 3/1995 | Caillat et al. |
| 5,411,384 | A | 5/1995 | Bass et al. |
| 5,425,626 | A | 6/1995 | Tojo et al. |
| 5,427,512 | A | 6/1995 | Kohsokabe et al. |
| 5,451,146 | A | 9/1995 | Inagaki et al. |
| 5,458,471 | A | 10/1995 | Ni |
| 5,458,472 | A | 10/1995 | Kobayashi et al. |
| 5,482,637 | A | 1/1996 | Rao et al. |
| 5,511,959 | A | 4/1996 | Tojo et al. |
| 5,547,354 | A | 8/1996 | Shimizu et al. |
| 5,551,846 | A | 9/1996 | Taylor et al. |
| 5,557,897 | A | 9/1996 | Kranz et al. |
| 5,562,426 | A | 10/1996 | Watanabe et al. |
| 5,577,897 | A | 11/1996 | Inagaki et al. |
| 5,591,014 | A | 1/1997 | Wallis et al. |
| 5,607,288 | A | 3/1997 | Wallis et al. |
| 5,611,674 | A | 3/1997 | Bass et al. |
| 5,613,841 | A | 3/1997 | Bass et al. |
| 5,624,247 | A | 4/1997 | Nakamura |
| 5,639,225 | A | 6/1997 | Matsuda et al. |
| 5,640,854 | A | 6/1997 | Fogt et al. |
| 5,649,817 | A | 7/1997 | Yamazaki |
| 5,660,539 | A | 8/1997 | Matsunaga et al. |
| 5,674,058 | A | 10/1997 | Matsuda et al. |
| 5,678,985 | A | 10/1997 | Brooke et al. |
| 5,707,210 | A | 1/1998 | Ramsey et al. |
| 5,722,257 | A | 3/1998 | Ishii et al. |
| 5,741,120 | A | 4/1998 | Bass et al. |
| 5,775,893 | A | 7/1998 | Takao et al. |
| 5,842,843 | A | 12/1998 | Haga |
| 5,855,475 | A | 1/1999 | Fujio et al. |
| 5,885,063 | A | 3/1999 | Makino et al. |
| 5,888,057 | A | 3/1999 | Kitano et al. |
| 5,938,417 | A | 8/1999 | Takao et al. |
| 5,993,171 | A | 11/1999 | Higashiyama |
| 5,993,177 | A | 11/1999 | Terauchi et al. |
| 6,010,312 | A | 1/2000 | Suitou et al. |
| 6,015,277 | A | 1/2000 | Richardson, Jr. |
| 6,030,192 | A | 2/2000 | Hill et al. |
| 6,047,557 | A | 4/2000 | Pham et al. |
| 6,068,459 | A | 5/2000 | Clarke et al. |
| 6,086,335 | A | 7/2000 | Bass et al. |
| 6,093,005 | A | 7/2000 | Nakamura |
| 6,095,765 | A | 8/2000 | Khalifa |
| 6,102,671 | A | 8/2000 | Yamamoto et al. |
| 6,120,255 | A | 9/2000 | Schumann et al. |
| 6,123,517 | A | 9/2000 | Brooke et al. |
| 6,123,528 | A | 9/2000 | Sun et al. |
| 6,132,179 | A | 10/2000 | Higashiyama |
| 6,139,287 | A | 10/2000 | Kuroiwa et al. |
| 6,139,291 | A | 10/2000 | Perevozchikov |
| 6,149,401 | A | 11/2000 | Iwanami et al. |
| 6,152,714 | A | 11/2000 | Mitsuya et al. |
| 6,164,940 | A | 12/2000 | Terauchi et al. |
| 6,174,149 | B1 | 1/2001 | Bush |
| 6,176,686 | B1 | 1/2001 | Wallis et al. |
| 6,179,589 | B1 | 1/2001 | Bass et al. |
| 6,182,646 | B1 | 2/2001 | Silberstein et al. |
| 6,202,438 | B1 | 3/2001 | Barito |
| 6,210,120 | B1 | 4/2001 | Hugenroth et al. |
| 6,213,731 | B1 | 4/2001 | Doepker et al. |
| 6,231,316 | B1 | 5/2001 | Wakisaka et al. |
| 6,257,840 | B1 | 7/2001 | Ignatiev et al. |
| 6,264,444 | B1 | 7/2001 | Nakane et al. |
| 6,267,565 | B1 | 7/2001 | Seibel et al. |
| 6,273,691 | B1 | 8/2001 | Morimoto et al. |
| 6,280,154 | B1 | 8/2001 | Clendenin et al. |
| 6,290,477 | B1 | 9/2001 | Gigon |
| 6,293,767 | B1 | 9/2001 | Bass |
| 6,293,776 | B1 | 9/2001 | Hahn et al. |
| 6,309,194 | B1 | 10/2001 | Fraser et al. |
| 6,322,340 | B1 | 11/2001 | Itoh et al. |
| 6,338,912 | B1 | 1/2002 | Ban et al. |
| 6,350,111 | B1 | 2/2002 | Perevozchikov et al. |
| 6,361,890 | B1 | 3/2002 | Ban et al. |
| 6,379,123 | B1 | 4/2002 | Makino et al. |
| 6,389,837 | B1 | 5/2002 | Morozumi |
| 6,412,293 | B1 | 7/2002 | Pham et al. |
| 6,413,058 | B1 | 7/2002 | Williams et al. |
| 6,419,457 | B1 | 7/2002 | Seibel et al. |
| 6,428,286 | B1 | 8/2002 | Shimizu et al. |
| 6,454,551 | B2 | 9/2002 | Kuroki et al. |
| 6,457,948 | B1 | 10/2002 | Pham |

(56) References Cited

U.S. PATENT DOCUMENTS

| | | | |
|---|---|---|---|
| 6,464,481 | B2 | 10/2002 | Tsubai et al. |
| 6,478,550 | B2 | 11/2002 | Matsuba et al. |
| 6,506,036 | B2 | 1/2003 | Tsubai et al. |
| 6,514,060 | B1 | 2/2003 | Ishiguro et al. |
| 6,537,043 | B1 | 3/2003 | Chen |
| 6,544,016 | B2 | 4/2003 | Gennami et al. |
| 6,558,143 | B2 | 5/2003 | Nakajima et al. |
| 6,589,035 | B1 | 7/2003 | Tsubono et al. |
| 6,619,062 | B1 | 9/2003 | Shibamoto et al. |
| 6,679,683 | B2 | 1/2004 | Seibel et al. |
| 6,705,848 | B2 | 3/2004 | Scancarello |
| 6,715,999 | B2 | 4/2004 | Ancel et al. |
| 6,746,223 | B2 | 6/2004 | Manole |
| 6,769,881 | B2 | 8/2004 | Lee |
| 6,769,888 | B2 | 8/2004 | Tsubono et al. |
| 6,773,242 | B1 | 8/2004 | Perevozchikov |
| 6,817,847 | B2 | 11/2004 | Agner |
| 6,821,092 | B1 | 11/2004 | Gehret et al. |
| 6,863,510 | B2 | 3/2005 | Cho |
| 6,881,046 | B2 | 4/2005 | Shibamoto et al. |
| 6,884,042 | B2 | 4/2005 | Zili et al. |
| 6,887,051 | B2 | 5/2005 | Sakuda et al. |
| 6,893,229 | B2 | 5/2005 | Choi et al. |
| 6,896,493 | B2 | 5/2005 | Chang et al. |
| 6,896,498 | B1 | 5/2005 | Patel |
| 6,913,448 | B2 | 7/2005 | Liang et al. |
| 6,984,114 | B2 | 1/2006 | Zili et al. |
| 7,018,180 | B2 | 3/2006 | Koo |
| 7,029,251 | B2 | 4/2006 | Chang et al. |
| 7,118,358 | B2 | 10/2006 | Tsubono et al. |
| 7,137,796 | B2 | 11/2006 | Tsubono et al. |
| 7,160,088 | B2 | 1/2007 | Peyton |
| 7,172,395 | B2 | 2/2007 | Shibamoto et al. |
| 7,197,890 | B2 | 4/2007 | Taras et al. |
| 7,207,787 | B2 | 4/2007 | Liang et al. |
| 7,228,710 | B2 | 6/2007 | Lifson |
| 7,229,261 | B2 | 6/2007 | Morimoto et al. |
| 7,255,542 | B2 | 8/2007 | Lifson et al. |
| 7,261,527 | B2 | 8/2007 | Alexander et al. |
| 7,311,740 | B2 | 12/2007 | Williams et al. |
| 7,344,365 | B2 | 3/2008 | Takeuchi et al. |
| RE40,257 | E | 4/2008 | Doepker et al. |
| 7,354,259 | B2 | 4/2008 | Tsubono et al. |
| 7,364,416 | B2 | 4/2008 | Liang et al. |
| 7,371,057 | B2 | 5/2008 | Shin et al. |
| 7,371,059 | B2 | 5/2008 | Ignatiev et al. |
| RE40,399 | E | 6/2008 | Hugenroth et al. |
| RE40,400 | E | 6/2008 | Bass et al. |
| 7,393,190 | B2 | 7/2008 | Lee et al. |
| 7,404,706 | B2 | 7/2008 | Ishikawa et al. |
| RE40,554 | E | 10/2008 | Bass et al. |
| 7,510,382 | B2 | 3/2009 | Jeong |
| 7,547,202 | B2 | 6/2009 | Knapke |
| 7,641,455 | B2 | 1/2010 | Fujiwara et al. |
| 7,674,098 | B2 | 3/2010 | Lifson |
| 7,695,257 | B2 | 4/2010 | Joo et al. |
| 7,717,687 | B2 | 5/2010 | Reinhart |
| 7,771,178 | B2 | 8/2010 | Perevozchikov et al. |
| 7,802,972 | B2 | 9/2010 | Shimizu et al. |
| 7,815,423 | B2 | 10/2010 | Guo et al. |
| 7,891,961 | B2 | 2/2011 | Shimizu et al. |
| 7,896,629 | B2 | 3/2011 | Ignatiev et al. |
| RE42,371 | E | 5/2011 | Peyton |
| 7,956,501 | B2 | 6/2011 | Jun et al. |
| 7,967,582 | B2 | 6/2011 | Akei et al. |
| 7,967,583 | B2 | 6/2011 | Stover et al. |
| 7,972,125 | B2 | 7/2011 | Stover et al. |
| 7,976,289 | B2 | 7/2011 | Masao |
| 7,976,295 | B2 | 7/2011 | Stover et al. |
| 7,988,433 | B2 | 8/2011 | Akei et al. |
| 7,988,434 | B2 | 8/2011 | Stover et al. |
| 8,025,492 | B2 | 9/2011 | Seibel et al. |
| 8,303,278 | B2 | 11/2012 | Roof et al. |
| 8,303,279 | B2 | 11/2012 | Hahn |
| 8,308,448 | B2 | 11/2012 | Fields et al. |
| 8,313,318 | B2 | 11/2012 | Stover et al. |
| 8,328,531 | B2 | 12/2012 | Milliff et al. |
| 8,393,882 | B2 | 3/2013 | Ignatiev et al. |
| 8,506,271 | B2 | 8/2013 | Seibel et al. |
| 8,517,703 | B2 | 8/2013 | Doepker |
| 8,585,382 | B2 | 11/2013 | Akei et al. |
| 8,616,014 | B2 | 12/2013 | Stover et al. |
| 8,672,646 | B2 | 3/2014 | Ishizono et al. |
| 8,757,988 | B2 | 6/2014 | Fukudome et al. |
| 8,790,098 | B2 | 7/2014 | Stover et al. |
| 8,840,384 | B2 | 9/2014 | Patel et al. |
| 8,857,200 | B2 | 10/2014 | Stover et al. |
| 8,932,036 | B2 | 1/2015 | Monnier et al. |
| 9,080,446 | B2 | 7/2015 | Heusler et al. |
| 9,127,677 | B2 | 9/2015 | Doepker |
| 9,145,891 | B2 | 9/2015 | Kim et al. |
| 9,169,839 | B2 | 10/2015 | Ishizono et al. |
| 9,217,433 | B2 | 12/2015 | Park et al. |
| 9,228,587 | B2 | 1/2016 | Lee et al. |
| 9,249,802 | B2 | 2/2016 | Doepker et al. |
| 9,297,383 | B2 | 3/2016 | Jin et al. |
| 9,303,642 | B2 | 4/2016 | Akei et al. |
| 9,435,340 | B2 | 9/2016 | Doepker et al. |
| 9,494,157 | B2 | 11/2016 | Doepker |
| 9,541,084 | B2 | 1/2017 | Ignatiev et al. |
| 9,556,862 | B2 | 1/2017 | Yoshihiro et al. |
| 9,605,677 | B2 | 3/2017 | Heidecker et al. |
| 9,624,928 | B2 | 4/2017 | Yamazaki et al. |
| 9,638,191 | B2 | 5/2017 | Stover |
| 9,651,043 | B2 | 5/2017 | Stover et al. |
| 9,777,730 | B2 | 10/2017 | Doepker et al. |
| 9,777,863 | B2 | 10/2017 | Higashidozono et al. |
| 9,790,940 | B2 | 10/2017 | Doepker et al. |
| 9,850,903 | B2 | 12/2017 | Perevozchikov |
| 9,869,315 | B2 | 1/2018 | Jang et al. |
| 9,879,674 | B2 | 1/2018 | Akei et al. |
| 9,885,347 | B2 | 2/2018 | Lachey et al. |
| 9,920,759 | B2 | 3/2018 | Sung et al. |
| 9,989,057 | B2 | 6/2018 | Lochner et al. |
| 10,066,622 | B2 | 9/2018 | Pax et al. |
| 10,087,936 | B2 | 10/2018 | Pax et al. |
| 10,094,380 | B2 | 10/2018 | Doepker et al. |
| 10,428,818 | B2 | 10/2019 | Jin et al. |
| 10,563,891 | B2 | 2/2020 | Smerud et al. |
| 10,724,523 | B2 | 7/2020 | Wu et al. |
| 10,815,999 | B2 | 10/2020 | Jeong |
| 10,907,633 | B2 | 2/2021 | Doepker et al. |
| 10,954,940 | B2 | 3/2021 | Akei et al. |
| 10,974,317 | B2 | 4/2021 | Ruxanda et al. |
| 2001/0010800 | A1 | 8/2001 | Kohsokabe et al. |
| 2002/0039540 | A1 | 4/2002 | Kuroki et al. |
| 2002/0057975 | A1 | 5/2002 | Nakajima et al. |
| 2003/0044296 | A1 | 3/2003 | Chen |
| 2003/0044297 | A1 | 3/2003 | Gennami et al. |
| 2003/0186060 | A1 | 10/2003 | Rao |
| 2003/0228235 | A1 | 12/2003 | Sowa et al. |
| 2004/0126259 | A1 | 7/2004 | Choi et al. |
| 2004/0136854 | A1 | 7/2004 | Kimura et al. |
| 2004/0146419 | A1 | 7/2004 | Kawaguchi et al. |
| 2004/0170509 | A1 | 9/2004 | Wehrenberg et al. |
| 2004/0184932 | A1 | 9/2004 | Lifson |
| 2004/0197204 | A1 | 10/2004 | Yamanouchi et al. |
| 2005/0019177 | A1 | 1/2005 | Shin et al. |
| 2005/0019178 | A1 | 1/2005 | Shin et al. |
| 2005/0053507 | A1 | 3/2005 | Takeuchi et al. |
| 2005/0069444 | A1 | 3/2005 | Peyton |
| 2005/0140232 | A1 | 6/2005 | Lee et al. |
| 2005/0201883 | A1 | 9/2005 | Clendenin et al. |
| 2005/0214148 | A1 | 9/2005 | Ogawa et al. |
| 2006/0099098 | A1 | 5/2006 | Lee et al. |
| 2006/0138879 | A1 | 6/2006 | Kusase et al. |
| 2006/0198748 | A1 | 9/2006 | Grassbaugh et al. |
| 2006/0228243 | A1 | 10/2006 | Sun et al. |
| 2006/0233657 | A1 | 10/2006 | Bonear et al. |
| 2007/0003666 | A1 | 1/2007 | Gutknecht et al. |
| 2007/0036661 | A1 | 2/2007 | Stover |
| 2007/0110604 | A1 | 5/2007 | Peyton |
| 2007/0130973 | A1 | 6/2007 | Lifson et al. |
| 2008/0115357 | A1 | 5/2008 | Li et al. |

(56) References Cited

U.S. PATENT DOCUMENTS

| | | | |
|---|---|---|---|
| 2008/0138227 | A1 | 6/2008 | Knapke |
| 2008/0159892 | A1 | 7/2008 | Huang et al. |
| 2008/0159893 | A1 | 7/2008 | Caillat |
| 2008/0196445 | A1 | 8/2008 | Lifson et al. |
| 2008/0223057 | A1 | 9/2008 | Lifson et al. |
| 2008/0226483 | A1 | 9/2008 | Iwanami et al. |
| 2008/0286118 | A1 | 11/2008 | Gu et al. |
| 2008/0305270 | A1 | 12/2008 | Uhlianuk et al. |
| 2009/0013701 | A1 | 1/2009 | Lifson et al. |
| 2009/0035167 | A1 | 2/2009 | Sun |
| 2009/0068048 | A1 | 3/2009 | Stover et al. |
| 2009/0071183 | A1 | 3/2009 | Stover et al. |
| 2009/0185935 | A1 | 7/2009 | Seibel et al. |
| 2009/0191080 | A1 | 7/2009 | Ignatiev et al. |
| 2009/0297377 | A1 | 12/2009 | Stover et al. |
| 2009/0297378 | A1 | 12/2009 | Stover et al. |
| 2009/0297379 | A1 | 12/2009 | Stover et al. |
| 2009/0297380 | A1 | 12/2009 | Stover et al. |
| 2010/0111741 | A1 | 5/2010 | Chikano et al. |
| 2010/0135836 | A1 | 6/2010 | Stover et al. |
| 2010/0158731 | A1 | 6/2010 | Akei et al. |
| 2010/0209278 | A1 | 8/2010 | Tarao et al. |
| 2010/0212311 | A1 | 8/2010 | McQuary et al. |
| 2010/0212352 | A1 | 8/2010 | Kim et al. |
| 2010/0254841 | A1 | 10/2010 | Akei et al. |
| 2010/0300659 | A1 | 12/2010 | Stover et al. |
| 2010/0303659 | A1 | 12/2010 | Stover et al. |
| 2011/0052437 | A1 | 3/2011 | Iitsuka et al. |
| 2011/0135509 | A1 | 6/2011 | Fields et al. |
| 2011/0206548 | A1 | 8/2011 | Doepker |
| 2011/0243777 | A1 | 10/2011 | Ito et al. |
| 2011/0250085 | A1 | 10/2011 | Stover et al. |
| 2011/0293456 | A1 | 12/2011 | Seibel et al. |
| 2012/0009076 | A1 | 1/2012 | Kim et al. |
| 2012/0107163 | A1 | 5/2012 | Monnier et al. |
| 2012/0183422 | A1 | 7/2012 | Bahmata |
| 2012/0195781 | A1 | 8/2012 | Stover et al. |
| 2013/0078128 | A1 | 3/2013 | Akei |
| 2013/0089448 | A1 | 4/2013 | Ginies et al. |
| 2013/0094987 | A1 | 4/2013 | Yamashita et al. |
| 2013/0121857 | A1 | 5/2013 | Liang et al. |
| 2013/0177465 | A1 | 7/2013 | Clendenin et al. |
| 2013/0195707 | A1 | 8/2013 | Kozuma et al. |
| 2013/0302198 | A1 | 11/2013 | Ginies et al. |
| 2013/0309118 | A1 | 11/2013 | Ginies et al. |
| 2013/0315768 | A1 | 11/2013 | Le Coat et al. |
| 2014/0023540 | A1 | 1/2014 | Heidecker et al. |
| 2014/0024563 | A1 | 1/2014 | Heidecker et al. |
| 2014/0037486 | A1 | 2/2014 | Stover et al. |
| 2014/0134030 | A1 | 5/2014 | Stover et al. |
| 2014/0134031 | A1 | 5/2014 | Doepker et al. |
| 2014/0147294 | A1 | 5/2014 | Fargo et al. |
| 2014/0154121 | A1 | 6/2014 | Doepker |
| 2014/0154124 | A1 | 6/2014 | Doepker et al. |
| 2014/0219846 | A1 | 8/2014 | Ignatiev et al. |
| 2015/0037184 | A1 | 2/2015 | Rood et al. |
| 2015/0086404 | A1 | 3/2015 | Kiem et al. |
| 2015/0192121 | A1 | 7/2015 | Sung et al. |
| 2015/0275898 | A1 | 10/2015 | Ahire et al. |
| 2015/0300353 | A1 | 10/2015 | Utpat et al. |
| 2015/0330386 | A1 | 11/2015 | Doepker |
| 2015/0345493 | A1 | 12/2015 | Lochner et al. |
| 2015/0354719 | A1 | 12/2015 | van Beek et al. |
| 2016/0025093 | A1 | 1/2016 | Doepker |
| 2016/0025094 | A1 | 1/2016 | Ignatiev et al. |
| 2016/0032924 | A1 | 2/2016 | Stover |
| 2016/0047380 | A1 | 2/2016 | Kim et al. |
| 2016/0053755 | A1 | 2/2016 | Taguchi |
| 2016/0053759 | A1 | 2/2016 | Choi et al. |
| 2016/0076543 | A1 | 3/2016 | Akei et al. |
| 2016/0115954 | A1 | 4/2016 | Doepker et al. |
| 2016/0138879 | A1 | 5/2016 | Matsukado et al. |
| 2016/0201673 | A1 | 7/2016 | Perevozchikov et al. |
| 2016/0208803 | A1 | 7/2016 | Uekawa et al. |
| 2017/0002817 | A1 | 1/2017 | Stover |
| 2017/0002818 | A1 | 1/2017 | Stover |
| 2017/0030354 | A1 | 2/2017 | Stover |
| 2017/0241417 | A1 | 8/2017 | Jin et al. |
| 2017/0268510 | A1 | 9/2017 | Stover et al. |
| 2017/0306960 | A1 | 10/2017 | Pax et al. |
| 2017/0314558 | A1 | 11/2017 | Pax et al. |
| 2017/0342978 | A1 | 11/2017 | Doepker |
| 2017/0342983 | A1 | 11/2017 | Jin et al. |
| 2017/0342984 | A1 | 11/2017 | Jin et al. |
| 2018/0023570 | A1 | 1/2018 | Huang et al. |
| 2018/0038369 | A1 | 2/2018 | Doepker et al. |
| 2018/0038370 | A1 | 2/2018 | Doepker et al. |
| 2018/0066656 | A1 | 3/2018 | Perevozchikov et al. |
| 2018/0066657 | A1 | 3/2018 | Perevozchikov et al. |
| 2018/0135625 | A1 | 5/2018 | Naganuma et al. |
| 2018/0149155 | A1 | 5/2018 | Akei et al. |
| 2018/0216618 | A1 | 8/2018 | Jeong |
| 2018/0223823 | A1 | 8/2018 | Ignatiev et al. |
| 2019/0040861 | A1 | 2/2019 | Doepker et al. |
| 2019/0101120 | A1 | 4/2019 | Perevozchikov et al. |
| 2019/0186491 | A1 | 6/2019 | Perevozchikov et al. |
| 2019/0203709 | A1 | 7/2019 | Her et al. |
| 2019/0353164 | A1 | 11/2019 | Berning et al. |
| 2020/0057458 | A1 | 2/2020 | Taguchi |
| 2020/0291943 | A1 | 9/2020 | McBean et al. |

FOREIGN PATENT DOCUMENTS

| | | | |
|---|---|---|---|
| CN | 1158944 | A | 9/1997 |
| CN | 1158945 | A | 9/1997 |
| CN | 1177681 | A | 4/1998 |
| CN | 1177683 | A | 4/1998 |
| CN | 1259625 | A | 7/2000 |
| CN | 1286358 | A | 3/2001 |
| CN | 1289011 | A | 3/2001 |
| CN | 1339087 | A | 3/2002 |
| CN | 1349053 | A | 5/2002 |
| CN | 1382912 | A | 12/2002 |
| CN | 1407233 | A | 4/2003 |
| CN | 1407234 | A | 4/2003 |
| CN | 1517553 | A | 8/2004 |
| CN | 1601106 | A | 3/2005 |
| CN | 1680720 | A | 10/2005 |
| CN | 1702328 | A | 11/2005 |
| CN | 2747381 | Y | 12/2005 |
| CN | 1757925 | A | 4/2006 |
| CN | 1828022 | A | 9/2006 |
| CN | 1854525 | A | 11/2006 |
| CN | 1963214 | A | 5/2007 |
| CN | 1995756 | A | 7/2007 |
| CN | 101358592 | A | 2/2009 |
| CN | 101684785 | A | 3/2010 |
| CN | 101761479 | A | 6/2010 |
| CN | 101806302 | A | 8/2010 |
| CN | 101910637 | A | 12/2010 |
| CN | 102076963 | A | 5/2011 |
| CN | 102089525 | A | 6/2011 |
| CN | 102272454 | A | 12/2011 |
| CN | 102400915 | A | 4/2012 |
| CN | 102422024 | A | 4/2012 |
| CN | 102449314 | A | 5/2012 |
| CN | 102705234 | A | 10/2012 |
| CN | 102762866 | A | 10/2012 |
| CN | 202926640 | U | 5/2013 |
| CN | 103502644 | A | 1/2014 |
| CN | 103671125 | A | 3/2014 |
| CN | 203962320 | U | 11/2014 |
| CN | 204041454 | U | 12/2014 |
| CN | 104838143 | A | 8/2015 |
| CN | 105317678 | A | 2/2016 |
| CN | 205533207 | U | 8/2016 |
| CN | 205823629 | U | 12/2016 |
| CN | 205876712 | U | 1/2017 |
| CN | 205876713 | U | 1/2017 |
| CN | 205895597 | U | 1/2017 |
| CN | 106662104 | A | 5/2017 |
| CN | 106979153 | A | 7/2017 |
| CN | 207513832 | U | 6/2018 |
| CN | 209621603 | U | 11/2019 |

(56) References Cited

FOREIGN PATENT DOCUMENTS

| | | | |
|---|---|---|---|
| CN | 209654225 | U | 11/2019 |
| CN | 209781195 | U | 12/2019 |
| DE | 3917656 | C2 | 11/1995 |
| DE | 102011001394 | A1 | 9/2012 |
| EP | 0256445 | A2 | 2/1988 |
| EP | 0747598 | A2 | 12/1996 |
| EP | 0822335 | A2 | 2/1998 |
| EP | 1067289 | A2 | 1/2001 |
| EP | 1087142 | A2 | 3/2001 |
| EP | 1182353 | A1 | 2/2002 |
| EP | 1241417 | A1 | 9/2002 |
| EP | 1371851 | A2 | 12/2003 |
| EP | 1382854 | A2 | 1/2004 |
| EP | 2151577 | A1 | 2/2010 |
| EP | 1927755 | A3 | 11/2013 |
| FR | 2764347 | A1 | 12/1998 |
| GB | 2107829 | A | 5/1983 |
| JP | S58214689 | A | 12/1983 |
| JP | S60259794 | A | 12/1985 |
| JP | S62220789 | A | 9/1987 |
| JP | S6385277 | A | 4/1988 |
| JP | S63205482 | A | 8/1988 |
| JP | H01178789 | A | 7/1989 |
| JP | H0281982 | A | 3/1990 |
| JP | H02153282 | A | 6/1990 |
| JP | H03081588 | A | 4/1991 |
| JP | H03233101 | A | 10/1991 |
| JP | H04121478 | A | 4/1992 |
| JP | H04272490 | A | 9/1992 |
| JP | H0610601 | A | 1/1994 |
| JP | H0726618 | B2 | 3/1995 |
| JP | H07293456 | A | 11/1995 |
| JP | H08247053 | A | 9/1996 |
| JP | H08320079 | A | 12/1996 |
| JP | H08334094 | A | 12/1996 |
| JP | H09177689 | A | 7/1997 |
| JP | H11107950 | A | 4/1999 |
| JP | H11166490 | A | 6/1999 |
| JP | 2951752 | B2 | 9/1999 |
| JP | H11324950 | A | 11/1999 |
| JP | 2000104684 | A | 4/2000 |
| JP | 2000161263 | A | 6/2000 |
| JP | 2000329078 | A | 11/2000 |
| JP | 3141949 | B2 | 3/2001 |
| JP | 2002202074 | A | 7/2002 |
| JP | 2003074481 | A | 3/2003 |
| JP | 2003074482 | A | 3/2003 |
| JP | 2003106258 | A | 4/2003 |
| JP | 2003214365 | A | 7/2003 |
| JP | 2003227479 | A | 8/2003 |
| JP | 2004239070 | A | 8/2004 |
| JP | 2005264827 | A | 9/2005 |
| JP | 2006083754 | A | 3/2006 |
| JP | 2006183474 | A | 7/2006 |
| JP | 2007154761 | A | 6/2007 |
| JP | 2007228683 | A | 9/2007 |
| JP | 2008248775 | A | 10/2008 |
| JP | 2008267707 | A | 11/2008 |
| JP | 2013104305 | A | 5/2013 |
| JP | 2013167215 | A | 8/2013 |
| KR | 870000015 | B1 | 1/1987 |
| KR | 20050027402 | A | 3/2005 |
| KR | 20050095246 | A | 9/2005 |
| KR | 100547323 | B1 | 1/2006 |
| KR | 20100017008 | A | 2/2010 |
| KR | 101009266 | B1 | 1/2011 |
| KR | 20120008045 | A | 1/2012 |
| KR | 101192642 | B1 | 10/2012 |
| KR | 20120115581 | A | 10/2012 |
| KR | 20130094646 | A | 8/2013 |
| WO | WO-9515025 | A1 | 6/1995 |
| WO | WO-0073659 | A1 | 12/2000 |
| WO | WO-2007046810 | A2 | 4/2007 |
| WO | WO-2008060525 | A1 | 5/2008 |
| WO | WO-2009017741 | A1 | 2/2009 |
| WO | WO-2009155099 | A2 | 12/2009 |
| WO | WO-2010118140 | A2 | 10/2010 |
| WO | WO-2011106422 | A2 | 9/2011 |
| WO | WO-2012114455 | A1 | 8/2012 |
| WO | WO-2017071641 | A1 | 5/2017 |

OTHER PUBLICATIONS

Notice of Allowance regarding U.S. Appl. No. 17/196,119 dated Apr. 26, 2023.

Office Action regarding U.S. Appl. No. 11/522,250, dated Aug. 1, 2007.

Office Action regarding Chinese Patent Application No. 200710153687.2, dated Mar. 6, 2009. Translation provided by CCPIT Patent and Trademark Law Office.

Office Action regarding U.S. Appl. No. 12/103,265, dated May 27, 2009.

Office Action regarding U.S. Appl. No. 12/103,265, dated Dec. 17, 2009.

Office Action regarding Korean Patent Application No. 10-2007-0093478, dated Feb. 25, 2010. Translation provided by Y.S. Chang & Associates.

Office Action regarding U.S. Appl. No. 12/103,265, dated Jun. 15, 2010.

Office Action regarding Korean Patent Application No. 10-2007-0093478, dated Aug. 31, 2010. Translation provided by Y.S. Chang & Associates.

Advisory Action regarding U.S. Appl. No. 12/103,265, dated Sep. 17, 2010.

Office Action regarding Chinese Patent Application No. 201010224582.3, dated Apr. 17, 2012. Translation provided by Unitalen Attorneys at Law.

Office Action regarding Indian Patent Application No. 1071/KOL/2007, dated Apr. 27, 2012.

Office Action regarding U.S. Appl. No. 13/036,529, dated Aug. 22, 2012.

International Search Report regarding International Application No. PCT/US2015/042479, dated Oct. 23, 2015.

Written Opinion of the International Searching Authority regarding International Application No. PCT/US2015/042479, dated Oct. 23, 2015.

Restriction Requirement regarding U.S. Appl. No. 14/809,786, dated Aug. 16, 2017.

International Search Report regarding International Application No. PCT/US2017/050525, dated Dec. 28, 2017.

Written Opinion of the International Searching Authority regarding International Application No. PCT/US2017/050525, dated Dec. 28, 2017.

Office Action regarding U.S. Appl. No. 14/809,786, dated Jan. 11, 2018.

Office Action regarding Chinese Patent Application No. 201580041209.5, dated Jan. 17, 2018. Translation provided by Unitalen Attorneys at Law.

International Search Report regarding International Application No. PCT/US2011/025921, dated Oct. 7, 2011.

Written Opinion of the International Search Authority regarding International Application No. PCT/US2011/025921, dated Oct. 7, 2011.

Written Opinion of the International Searching Authority regarding International Application No. PCT/US2010/030248, dated Nov. 26, 2010.

International Search Report regarding International Application No. PCT/US2010/030248, dated Nov. 26, 2010.

Office Action regarding U.S. Appl. No. 13/181,065, dated Nov. 9, 2012.

Office Action regarding U.S. Appl. No. 11/645,288, dated Nov. 30, 2009.

Search Report regarding European Patent Application No. 07254962.9, dated Mar. 12, 2008.

Office Action regarding Chinese Patent Application No. 200710160038.5, dated Jul. 8, 2010. Translation provided by Unitalen Attorneys At Law.

(56) References Cited

OTHER PUBLICATIONS

Office Action regarding Chinese Patent Application No. 200710160038.5, dated Jan. 31, 2012. Translation provided by Unitalen Attorneys At Law.
Office Action regarding Chinese Patent Application No. 201080020243.1, dated Nov. 5, 2013. Translation provided by Unitalen Attorneys At Law.
International Search Report regarding International Application No. PCT/US2013/051678, dated Oct. 21, 2013.
Written Opinion of the International Searching Authority regarding International Application No. PCT/US2013/051678, dated Oct. 21, 2013.
International Search Report regarding International Application No. PCT/US2013/069462, dated Feb. 21, 2014.
Written Opinion of the International Searching Authority regarding International Application No. PCT/US2013/069462, dated Feb. 21, 2014.
International Search Report regarding International Application No. PCT/US2013/070981, dated Mar. 4, 2014.
Written Opinion of the International Searching Authority regarding International Application No. PCT/US2013/070981, dated Mar. 4, 2014.
International Search Report regarding International Application No. PCT/US2013/069456, dated Feb. 18, 2014.
Written Opinion of the International Searching Authority regarding International Application No. PCT/US2013/069456, dated Feb. 18, 2014.
International Search Report regarding International Application No. PCT/US2013/070992, dated Feb. 25, 2014.
Written Opinion of the International Searching Authority regarding International Application No. PCT/US2013/070992, dated Feb. 25, 2014.
Office Action regarding Chinese Patent Application No. 201180010366.1, dated Dec. 31, 2014. Translation provided by Unitalen Attorneys At Law.
Office Action regarding U.S. Appl. No. 14/081,390, dated Mar. 27, 2015.
Search Report regarding European Patent Application No. 10762374.6, dated Jun. 16, 2015.
Office Action regarding U.S. Appl. No. 14/060,240, dated Aug. 12, 2015.
International Search Report regarding International Application No. PCT/US2015/033960, dated Sep. 1, 2015.
Written Opinion of the International Searching Authority regarding International Application No. PCT/US2015/033960, dated Sep. 1, 2015.
Office Action regarding U.S. Appl. No. 14/073,293, dated Sep. 25, 2015.
Restriction Requirement regarding U.S. Appl. No. 14/060,102, dated Oct. 7, 2015.
Notice of Allowance regarding U.S. Appl. No. 14/060,240, dated Dec. 1, 2015.
Office Action regarding Chinese Patent Application No. 201410461048.2, dated Nov. 30, 2015. Translation provided by Unitalen Attorneys at Law.
Office Action regarding U.S. Appl. No. 14/073,293, dated Jan. 29, 2016.
Restriction Requirement regarding U.S. Appl. No. 14/060,102, dated Mar. 16, 2016.
Office Action regarding Chinese Patent Application No. 201410460792.0, dated Feb. 25, 2016. Translation provided by Unitalen Attorneys at Law.
Advisory Action regarding U.S. Appl. No. 14/073,293, dated Apr. 18, 2016.
Office Action regarding Chinese Patent Application No. 201380059666.8, dated Apr. 5, 2016. Translation provided by Unitalen Attorneys At Law.
Office Action regarding Chinese Patent Application No. 201380062614.6, dated Apr. 5, 2016. Translation provided by Unitalen Attorneys At Law.
Office Action regarding Chinese Patent Application No. 201380062657.4, dated May 4, 2016. Translation provided by Unitalen Attorneys at Law.
Office Action regarding Chinese Patent Application No. 201380059963.2, dated May 10, 2016. Translation provided by Unitalen Attorneys at Law.
Office Action regarding U.S. Appl. No. 14/060,102, dated Jun. 14, 2016.
Office Action regarding U.S. Appl. No. 14/846,877, dated Jul. 15, 2016.
Office Action regarding Chinese Patent Application No. 201410461048.2, dated Jul. 26, 2016. Translation provided by Unitalen Attorneys at Law.
Search Report regarding European Patent Application No. 13858194.7, dated Aug. 3, 2016.
Search Report regarding European Patent Application No. 13859308.2, dated Aug. 3, 2016.
Office Action regarding U.S. Appl. No. 14/294,458, dated Aug. 19, 2016.
Office Action regarding Chinese Patent Application No. 201410460792.0, dated Oct. 21, 2016. Translation provided by Unitalen Attorneys At Law.
Search Report regarding European Patent Application No. 11747996.4, dated Nov. 7, 2016.
Office Action regarding Chinese Patent Application No. 201380059666.8, dated Nov. 23, 2016. Translation provided by Unitalen Attorneys at Law.
Office Action regarding U.S. Appl. No. 14/060,102, dated Dec. 28, 2016.
Office Action regarding U.S. Appl. No. 15/156,400, dated Feb. 23, 2017.
Office Action regarding U.S. Appl. No. 14/294,458, dated Feb. 28, 2017.
Advisory Action regarding U.S. Appl. No. 14/060,102, dated Mar. 3, 2017.
Office Action regarding U.S. Appl. No. 14/663,073, dated Apr. 11, 2017.
Office Action regarding Chinese Patent Application No. 201410460792.0, dated Apr. 24, 2017. Translation provided by Unitalen Attorneys at Law.
Office Action regarding U.S. Appl. No. 14/946,824, dated May 10, 2017.
Advisory Action regarding U.S. Appl. No. 14/294,458, dated Jun. 9, 2017.
Office Action regarding Chinese Patent Application No. 201610703191.7, dated Jun. 13, 2017. Translation provided by Unitalen Attorneys at Law.
Office Action regarding Indian Patent Application No. 2043/MUMNP/2011, dated Jul. 28, 2017.
International Search Report regarding International Application No. PCT/CN2016/103763, dated Jan. 25, 2017.
Written Opinion of the International Searching Authority regarding International Application No. PCT/CN2016/103763, dated Jan. 25, 2017.
Office Action regarding U.S. Appl. No. 14/294,458, dated Sep. 21, 2017.
Office Action regarding U.S. Appl. No. 14/757,407, dated Oct. 13, 2017.
Office Action regarding Chinese Patent Application No. 201410460792.0, dated Nov. 1, 2017. Translation provided by Unitalen Attorneys At Law.
Office Action regarding Chinese Patent Application No. 201610158216.X, dated Oct. 30, 2017. Translation provided by Unitalen Attorneys at Law.
Office Action regarding Chinese Patent Application No. 201610512702.7, dated Dec. 20, 2017. Partial translation provided by Unitalen Attorneys at Law.
Office Action regarding Chinese Patent Application No. 201610499158.7, dated Jan. 9, 2018. Translation provided by Unitalen Attorneys at Law.
Office Action regarding Chinese Patent Application No. 201580029636.1, dated Jan. 17, 2018. Translation provided by Unitalen Attorneys at Law.

(56) References Cited

OTHER PUBLICATIONS

Office Action regarding U.S. Appl. No. 15/651,471, dated Feb. 23, 2018.
Office Action regarding U.S. Appl. No. 15/646,654, dated Feb. 9, 2018.
Office Action regarding Indian Patent Application No. 1907/MUMNP/2012, dated Feb. 26, 2018.
Restriction Requirement regarding U.S. Appl. No. 15/784,458, dated Apr. 5, 2018.
Restriction Requirement regarding U.S. Appl. No. 15/186,092, dated Apr. 3, 2018.
Office Action regarding U.S. Appl. No. 15/186,151, dated May 3, 2018.
Restriction Requirement regarding U.S. Appl. No. 15/187,225, dated May 15, 2018.
Notice of Allowance regarding U.S. Appl. No. 14/757,407, dated May 24, 2018.
Office Action regarding Chinese Patent Application No. 201610930347.5, dated May 14, 2018. Translation provided by Unitalen Attorneys at Law.
Office Action regarding U.S. Appl. No. 15/186,092, dated Jun. 29, 2018.
Notice of Allowance regarding U.S. Appl. No. 15/646,654, dated Jul. 11, 2018.
Notice of Allowance regarding U.S. Appl. No. 15/651,471, dated Jul. 11, 2018.
Office Action regarding Korean Patent Application No. 10-2016-7034539, dated Apr. 11, 2018. Translation provided by Y.S. Chang & Associates.
Office Action regarding Chinese Patent Application No. 201610158216.X, dated Jun. 13, 2018. Translation provided by Unitalen Attorneys at Law.
Office Action regarding U.S. Appl. No. 15/784,540, dated Jul. 17, 2018.
Office Action regarding European Patent Application No. 13859308.2, dated Jun. 22, 2018.
Office Action regarding U.S. Appl. No. 15/784,458, dated Jul. 19, 2018.
Restriction Requirement regarding U.S. Appl. No. 15/587,735, dated Jul. 23, 2018.
Interview Summary regarding U.S. Appl. No. 15/186,092, dated Aug. 14, 2018.
Office Action regarding U.S. Appl. No. 15/187,225, dated Aug. 27, 2018.
Office Action regarding Indian Patent Application No. 1307/MUMNP/2015, dated Sep. 12, 2018.
Office Action regarding Chinese Patent Application No. 201610499158.7, dated Aug. 1, 2018. Translation provided by Unitalen Attorneys at Law.
Office Action regarding Korean Patent Application No. 10-2016-7034539, dated Sep. 6, 2018. Translation provided by Y.S. Chang & Associates.
Office Action regarding U.S. Appl. No. 15/587,735, dated Oct. 9, 2018.
Office Action regarding Chinese Patent Application No. 201710795228.8, dated Sep. 5, 2018. Translation provided by Unitalen Attorneys at Law.
Office Action regarding Chinese Patent Application No. 201580029636.1, dated Oct. 8, 2018. Translation provided by Unitalen Attorneys at Law.
Office Action regarding U.S. Appl. No. 15/186,151, dated Nov. 1, 2018.
Luckevich, Mark, "MEMS microvalves: the new valve world." Valve World, May 2007, pp. 79-83.
Office Action regarding Korean Patent Application No. 10-2017-7033995, dated Nov. 29, 2018. Translation provided by KS KORYO International IP Law Firm.
Office Action regarding Indian Patent Application No. 1306/MUMNP/2015, dated Dec. 31, 2018.
Notice of Allowance regarding U.S. Appl. No. 15/187,225, dated Jan. 3, 2019.
Notice of Allowance regarding U.S. Appl. No. 15/186,092, dated Dec. 20, 2018.
Notice of Allowance regarding U.S. Appl. No. 15/784,458, dated Feb. 7, 2019.
Notice of Allowance regarding U.S. Appl. No. 15/784,540, dated Feb. 7, 2019.
Office Action regarding Chinese Patent Application No. 201610516097.0, dated Jun. 27, 2017. Translation provided by Unitalen Attorneys at Law.
Search Report regarding European Patent Application No. 18198310.7, dated Feb. 27, 2019.
Office Action regarding Chinese Patent Application No. 201610499158.7, dated Feb. 1, 2019. Translation provided by Unitalen Attorneys at Law.
Office Action regarding Chinese Patent Application No. 201180010366.1, dated Jun. 4, 2014. Translation provided by Unitalen Attorneys at Law.
Notice of Allowance regarding U.S. Appl. No. 15/186,151, dated Mar. 19, 2019.
Office Action regarding Chinese Patent Application No. 201710795228.8, dated Apr. 29, 2019. Translation provided by Unitalen Attorneys at Law.
Office Action regarding U.S. Appl. No. 15/587,735, dated May 17, 2019.
Notice of Allowance regarding U.S. Appl. No. 15/187,225, dated May 2, 2019.
Notice of Allowance regarding U.S. Appl. No. 15/186,092, dated Apr. 19, 2019.
Office Action regarding European Patent Application No. 11747996.4, dated Jun. 26, 2019.
Office Action regarding Chinese Patent Application No. 201811011292.3, dated Jun. 21, 2019. Translation provided by Unitalen Attorneys at Law.
Notice of Allowance regarding U.S. Appl. No. 15/186,151, dated Jul. 25, 2019.
Notice of Allowance regarding U.S. Appl. No. 15/587,735, dated Aug. 23, 2019.
Office Action regarding U.S. Appl. No. 15/692,844, dated Sep. 20, 2019.
Office Action regarding Chinese Patent Application No. 201610499158.7, dated Aug. 1, 2019. Translation provided by Unitalen Attorneys at Law.
Office Action regarding Chinese Patent Application No. 201780055443.2, dated Sep. 2, 2019. Translation provided by Unitalen Attorneys at Law.
Restriction Requirement regarding U.S. Appl. No. 15/682,599, dated Aug. 14, 2019.
Office Action regarding Chinese Patent Application No. 201811168307.7, dated Aug. 12, 2019. Translation provided by Unitalen Attorneys at Law.
International Search Report regarding International Application No. PCT/US2019/032718, dated Aug. 23, 2019.
Written Opinion of the International Searching Authority regarding International Application No. PCT/US2019/032718, dated Aug. 23, 2019.
Office Action regarding European Patent Application No. 11747996.4, dated Nov. 5, 2019.
Notice of Allowance regarding U.S. Appl. No. 15/186,151, dated Nov. 14, 2019.
Office Action regarding Chinese Patent Application No. 201710795228.8, dated Oct. 28, 2019. Translation provided by Unitalen Attorneys at Law.
Office Action regarding U.S. Appl. No. 15/682,599, dated Jan. 24, 2020.
Office Action regarding U.S. Appl. No. 15/881,016, dated Jan. 23, 2020.
Office Action regarding U.S. Appl. No. 15/831,423, dated Jan. 31, 2020.
Office Action regarding Chinese Patent Application No. 201811480347.5, dated Jan. 10, 2020. Translation provided by Unitalen Attorneys at Law.

(56) References Cited

OTHER PUBLICATIONS

Office Action regarding European Patent Application No. 11747996.4, dated Jan. 14, 2020.
Office Action regarding Indian Patent Application No. 2043/MUMNP/2011, dated Nov. 27, 2019.
Office Action regarding Chinese Patent Application No. 201811541653.5, dated Jan. 10, 2020. Translation provided by Unitalen Attorneys at Law.
Notice of Allowance regarding U.S. Appl. No. 15/692,844, dated Feb. 20, 2020.
Office Action regarding Chinese Patent Application No. 201811168307.7, dated Mar. 27, 2020. Translation provided by Unitalen Attorneys at Law.
Office Action regarding European Patent Application No. 13859308.2, dated Mar. 4, 2020.
Office Action regarding Korean Patent Application No. 10-2018-0159231, dated Apr. 7, 2020. Translation provided by KS KORYO International IP Law Firm.
Notice of Allowance regarding U.S. Appl. No. 15/682,599, dated Apr. 22, 2020.
Office Action regarding Chinese Patent Application No. 201780055443.2, dated Apr. 14, 2020. Translation provided by Unitalen Attorneys At Law.
Notice of Allowance regarding U.S. Appl. No. 15/831,423, dated May 20, 2020.
Restriction Requirement regarding U.S. Appl. No. 16/147,920, dated Jun. 25, 2020.
Notice of Allowance regarding U.S. Appl. No. 15/692,844, dated Jun. 4, 2020.
Office Action regarding U.S. Appl. No. 16/154,406, dated Jun. 29, 2020.
Restriction Requirement regarding U.S. Appl. No. 16/154,844, dated Jul. 2, 2020.
International Search Report regarding International Application No. PCT/US2020/022030, dated Jul. 2, 2020.
Written Opinion of the International Searching Authority regarding International Application No. PCT/US2020/022030, dated Jul. 2, 2020.
Office Action regarding U.S. Appl. No. 16/177,902, dated Jul. 23, 2020.
Office Action regarding U.S. Appl. No. 15/881,016, dated Jul. 21, 2020.
Office Action regarding Chinese Patent Application No. 201811480347.5, dated Jul. 21, 2020. Translation provided by Unitalen Attorneys at Law.
Notice of Allowance regarding U.S. Appl. No. 16/154,406, dated Oct. 2, 2020.
Office Action regarding U.S. Appl. No. 16/154,844, dated Oct. 5, 2020.
Office Action regarding U.S. Appl. No. 16/147,920, dated Sep. 25, 2020.
Notice of Allowance regarding U.S. Appl. No. 15/881,016, dated Nov. 17, 2020.
Notice of Allowance regarding U.S. Appl. No. 16/177,902, dated Nov. 27, 2020.
Notice of Allowance regarding U.S. Appl. No. 16/147,920, dated Feb. 2, 2021.
Notice of Allowance regarding U.S. Appl. No. 16/154,844, dated Feb. 10, 2021.
Heatcraft RPD; *How and Why we use Capacity Control*; dated Jan. 17, 2016; 12 Pages.
Non-Final Office Action regarding U.S. Appl. No. 17/176,080 dated Mar. 30, 2022.
First Chinese Office Action & Search Report regarding Application No. 201980040745.1 dated Jan. 6, 2022. English translation provided by Unitalen Attorneys at Law.
Non-Final Office Action regarding U.S. Appl. No. 17/388,923 dated Jun. 9, 2022.
Notice of Allowance regarding U.S. Appl. No. 17/157,588 dated Jun. 16, 2022.
Final Office Action regarding U.S. Appl. No. 17/176,080 dated Aug. 12, 2022.
Advisory Action regarding U.S. Appl. No. 17/176,080 dated Oct. 17, 2022.
Performance of the Use of Plastics in Oil-Free Scroll Compressors, Shaffer et al., 2012.
Notice of Allowance regarding U.S. Appl. No. 17/176,080 dated Dec. 15, 2022.
Corrected Notice of Allowance regarding U.S. Appl. No. 17/176,080 dated Dec. 21, 2022.
Notice of Allowance regarding U.S. Appl. No. 17/176,080 dated Feb. 8, 2023.
Non-Final Office Action regarding U.S. Appl. No. 17/886,047 dated May 17, 2023.

COMPRESSOR MODULATION SYSTEM WITH MULTI-WAY VALVE

CROSS-REFERENCE TO RELATED APPLICATIONS

This application is a continuation of U.S. patent application Ser. No. 17/388,923 filed on Jul. 29, 2021. The entire disclosure of the above application is incorporated herein by reference.

FIELD

The present disclosure relates to a compressor including a capacity modulation system with a multi-way valve.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and one or more compressors circulating a working fluid (e.g., a refrigerant) between the indoor and outdoor heat exchangers. Efficient and reliable operation of the one or more compressors is desirable to ensure that the climate-control system in which the one or more compressors are installed is capable of effectively and efficiently providing a cooling and/or heating effect on demand.

SUMMARY

This section provides a general summary of the disclosure and is not a comprehensive disclosure of its full scope or all of its features.

In one form, the present disclosure provides a compressor that may include a first scroll, a second scroll, an axial biasing chamber, and a modulation control valve (e.g., a multi-way valve). The first scroll includes a first end plate and a first spiral wrap extending from the first end plate. The second scroll includes a second end plate and a second spiral wrap extending from the second end plate. The first and second spiral wraps mesh with each other and form a plurality of compression pockets therebetween. The compression pockets include a suction-pressure compression pocket, a discharge-pressure compression pocket at a higher pressure than the suction-pressure compression pocket, and a plurality of intermediate-pressure compression pockets at respective pressures between the pressures of the suction and discharge compression pockets. The second end plate may include an outer port and an inner port. The outer port is disposed radially outward relative to the inner port. The outer port may be open to a first one of the intermediate-pressure compression pockets, and the inner port may be open to a second one of the intermediate-pressure compression pockets. The axial biasing chamber may be disposed axially between the second end plate and a component (e.g., a floating seal, a partition, or an end cap of a shell assembly, for example). The component may partially define the axial biasing chamber. Working fluid disposed within the axial biasing chamber may axially bias the second scroll toward the first scroll. The modulation control valve may be in fluid communication with the inner port, the outer port, and the axial biasing chamber. The modulation control valve is movable between a first position and a second position. Movement of the modulation control valve into the first position may switch the compressor into a reduced-capacity mode and allow fluid communication between the inner port and the axial biasing chamber while preventing fluid communication between the outer port and the axial biasing chamber. Movement of the modulation control valve into the second position may switch the compressor into a full-capacity mode and allow fluid communication between the outer port and the axial biasing chamber while preventing fluid communication between the inner port and the axial biasing chamber.

In some configurations of the compressor of the above paragraph, the second end plate includes one or more modulation ports in fluid communication with one or more of the intermediate-pressure compression pockets. Movement of the modulation control valve into the first position may allow fluid flow through the one or more modulation ports. Movement of the modulation control valve into the second position may prevent fluid flow through the one or more modulation ports.

In some configurations, the compressor of either of the above paragraphs may include a valve ring movable relative to the second end plate between a first position in which the valve ring is spaced apart from the second end plate to allow fluid flow through the one or more modulation ports and a second position in which the valve ring blocks fluid flow through the one or more modulation ports.

In some configurations of the compressor of any of the above paragraphs, the valve ring cooperates with the component to define the axial biasing chamber. The valve ring may partially define a modulation control chamber. The modulation control valve may be in fluid communication with the modulation control chamber.

In some configurations of the compressor of any of the above paragraphs, movement of the modulation control valve into the first position allows fluid communication between the modulation control chamber and the axial biasing chamber via the modulation control valve. Movement of the modulation control valve into the second position may allow fluid communication between the modulation control chamber and a suction-pressure region of the compressor.

In some configurations of the compressor of any of the above paragraphs, the component is a floating seal assembly.

In some configurations of the compressor of any of the above paragraphs, the first scroll is an orbiting scroll, and the second scroll is a non-orbiting scroll.

In some configurations of the compressor of any of the above paragraphs, the modulation control valve includes a valve body and a valve member movable relative to the valve body between the first and second positions. The valve body may include a first port, a second port, a third port, a fourth port, a fifth port, and a sixth port.

In some configurations of the compressor of any of the above paragraphs, the valve body includes a first cavity and a second cavity that are fluidly separated from each other. The first cavity may be fluidly connected with the first, second, and third ports. The second cavity may be fluidly connected with the fourth, fifth, and sixth ports.

In some configurations of the compressor of any of the above paragraphs, when the valve member is in the first position: the first and second ports are in fluid communication with the first cavity, fluid communication between the third port and the first cavity is prevented, fluid communication between the fourth port and the second cavity is prevented, and the fifth and sixth ports are in fluid communication with the second cavity.

In some configurations of the compressor of any of the above paragraphs, when the valve member is in the second position: the first and third ports are in fluid communication with the first cavity, fluid communication between the second port and the first cavity is prevented, fluid communication between the fifth port and the second cavity is prevented, and the fourth and sixth ports are in fluid communication with the second cavity.

In some configurations of the compressor of any of the above paragraphs, the first port is fluidly connected with a modulation control chamber defined by a valve ring that opens modulation ports in the second end plate when the valve member is in the first position.

In some configurations of the compressor of any of the above paragraphs, the second port may be fluidly connected with the axial biasing chamber.

In some configurations of the compressor of any of the above paragraphs, the third port is fluidly connected with a suction-pressure region of the compressor.

In some configurations of the compressor of any of the above paragraphs, the fourth port is fluidly connected with the outer port.

In some configurations of the compressor of any of the above paragraphs, the fifth port is fluidly connected with the inner port.

In some configurations of the compressor of any of the above paragraphs, the sixth port is fluidly connected with the axial biasing chamber.

In some configurations of the compressor of any of the above paragraphs, the valve member includes a first plug, a second plug, a third plug, and a fourth plug.

In some configurations of the compressor of any of the above paragraphs, the first, second, third, and fourth plugs are movable together between the first and second positions.

In some configurations of the compressor of any of the above paragraphs, the first plug closes an end of the third port in the first position and opens the end of the third port in the second position.

In some configurations of the compressor of any of the above paragraphs, the second plug opens an end of the second port in the first position and closes the end of the second port in the second position.

In some configurations of the compressor of any of the above paragraphs, the third plug closes an end of the fourth port in the first position and opens the end of the fourth port in the second position.

In some configurations of the compressor of any of the above paragraphs, the fourth plug opens an end of the fifth port in the first position and closes the end of the fifth port in the second position.

In another form, the present disclosure provides a compressor that may include a shell assembly, an orbiting scroll, a non-orbiting scroll, an axial biasing chamber, and a modulation control valve. The orbiting scroll is disposed within the shell assembly and includes a first end plate and a first spiral wrap extending from the first end plate. The non-orbiting scroll is disposed within the shell assembly and includes a second end plate and a second spiral wrap extending from the second end plate. The first and second spiral wraps mesh with each other and form a plurality of compression pockets therebetween. The compression pockets include a suction-pressure compression pocket, a discharge-pressure compression pocket at a higher pressure than the suction-pressure compression pocket, and a plurality of intermediate-pressure compression pockets at respective pressures between the pressures of the suction and discharge compression pockets. The second end plate may include an outer port, an inner port, and a modulation port. The outer port is disposed radially outward relative to the inner port. The outer port may be open to a first one of the intermediate-pressure compression pockets. The inner port may be open to a second one of the intermediate-pressure compression pockets. The axial biasing chamber may be disposed axially between the second end plate and a component (e.g., a floating seal, a partition, or an end cap of a shell assembly, for example). The component may partially define the axial biasing chamber. Working fluid disposed within the axial biasing chamber axially biases the non-orbiting scroll toward the orbiting scroll. The modulation control valve may be in fluid communication with the inner port, the outer port, and the axial biasing chamber. The modulation control valve is movable between a first position and a second position. Movement of the modulation control valve into the first position may switch the compressor into a reduced-capacity mode and allow fluid communication between the inner port and the axial biasing chamber while preventing fluid communication between the outer port and the axial biasing chamber. Movement of the modulation control valve into the first position may allow fluid flow through the modulation port. Movement of the modulation control valve into the second position may switch the compressor into a full-capacity mode and allow fluid communication between the outer port and the axial biasing chamber while preventing fluid communication between the inner port and the axial biasing chamber. Movement of the modulation control valve into the second position may prevent fluid flow through the modulation port.

In some configurations of the compressor of the above paragraph, the modulation control valve includes a valve body and a valve member movable relative to the valve body between the first and second positions. The valve body may include a first port, a second port, a third port, a fourth port, a fifth port, and a sixth port.

In some configurations of the compressor of either of the above paragraphs, the valve body includes a first cavity and a second cavity that are fluidly separated from each other.

In some configurations of the compressor of any of the above paragraphs, the first cavity is fluidly connected with the first, second, and third ports.

In some configurations of the compressor of any of the above paragraphs, the second cavity is fluidly connected with the fourth, fifth, and sixth ports.

In some configurations of the compressor of any of the above paragraphs, when the valve member is in the first position: the first and second ports are in fluid communication with the first cavity, fluid communication between the third port and the first cavity is prevented, fluid communication between the fourth port and the second cavity is prevented, and the fifth and sixth ports are in fluid communication with the second cavity.

In some configurations of the compressor of any of the above paragraphs, when the valve member is in the second position: the first and third ports are in fluid communication with the first cavity, fluid communication between the second port and the first cavity is prevented, fluid communication between the fifth port and the second cavity is prevented, and the fourth and sixth ports are in fluid communication with the second cavity.

In some configurations of the compressor of any of the above paragraphs, the first port is fluidly connected with a modulation control chamber defined by a valve ring that opens the modulation port in the second end plate when the valve member is in the first position.

In some configurations of the compressor of any of the above paragraphs, the second port is fluidly connected with the axial biasing chamber.

In some configurations of the compressor of any of the above paragraphs, the third port is fluidly connected with a suction-pressure region of the compressor.

In some configurations of the compressor of any of the above paragraphs, the fourth port is fluidly connected with the outer port.

In some configurations of the compressor of any of the above paragraphs, the fifth port is fluidly connected with the inner port.

In some configurations of the compressor of any of the above paragraphs, the sixth port is fluidly connected with the axial biasing chamber.

In some configurations of the compressor of any of the above paragraphs, the valve member includes a first plug, a second plug, a third plug, and a fourth plug.

In some configurations of the compressor of any of the above paragraphs, the first, second, third, and fourth plugs are movable together between the first and second positions.

In some configurations of the compressor of any of the above paragraphs, the first plug closes an end of the third port in the first position and opens the end of the third port in the second position.

In some configurations of the compressor of any of the above paragraphs, the second plug opens an end of the second port in the first position and closes the end of the second port in the second position.

In some configurations of the compressor of any of the above paragraphs, the third plug closes an end of the fourth port in the first position and opens the end of the fourth port in the second position.

In some configurations of the compressor of any of the above paragraphs, the fourth plug opens an end of the fifth port in the first position and closes the end of the fifth port in the second position.

In some configurations of the compressor of any of the above paragraphs, the valve ring closes the modulation port when the valve member is in the second position.

In some configurations of the compressor of any of the above paragraphs, the valve ring cooperates with the component to define the axial biasing chamber.

In some configurations of the compressor of any of the above paragraphs, the modulation control valve is in fluid communication with the modulation control chamber.

In some configurations of the compressor of any of the above paragraphs, movement of the modulation control valve into the first position allows fluid communication between the modulation control chamber and the axial biasing chamber via the modulation control valve.

In some configurations of the compressor of any of the above paragraphs, movement of the modulation control valve into the second position allows fluid communication between the modulation control chamber and a suction-pressure region of the compressor.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations and are not intended to limit the scope of the present disclosure.

Corresponding reference numerals indicate corresponding parts throughout the several views of the drawings.

DETAILED DESCRIPTION

Figure 1:
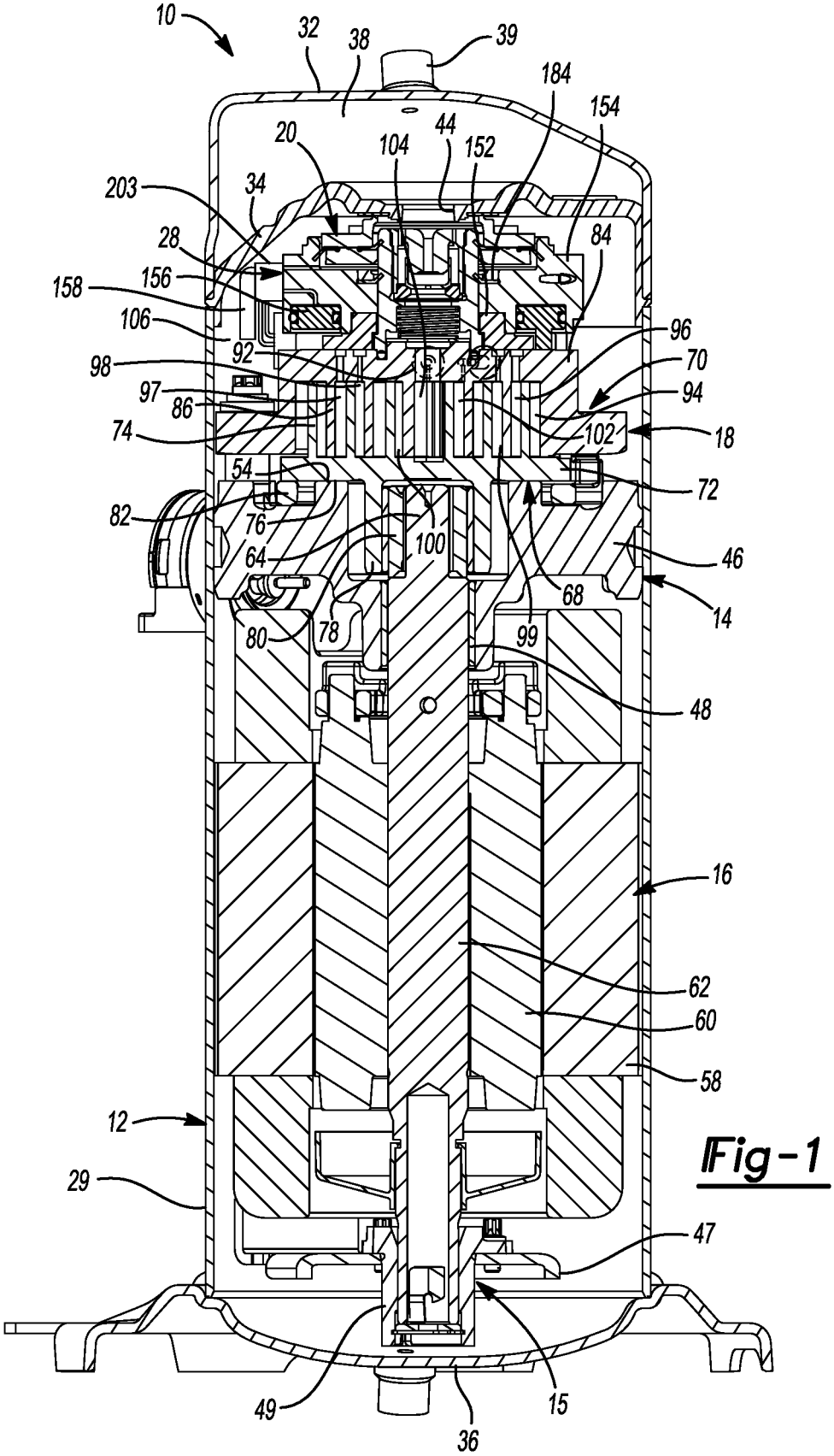
FIG. 1 is a cross-sectional view of a compressor having a capacity modulation assembly according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a compressor 10 is provided that may include a hermetic shell assembly 12, a first bearing housing assembly 14, a second bearing housing assembly 15, a motor assembly 16, a compression mechanism 18, a floating seal assembly 20, and a capacity modulation assembly 28. The shell assembly 12 may house the bearing housing assemblies 14, 15, the motor assembly 16, the compression mechanism 18, the seal assembly 20, and the capacity modulation assembly 28.

The shell assembly 12 forms a compressor housing and may include a cylindrical shell 29, an end cap 32 at the upper end thereof, a transversely extending partition 34, and a base 36 at a lower end thereof. The end cap 32 and partition 34 may generally define a discharge chamber 38. The discharge chamber 38 may generally form a discharge muffler for compressor 10. While the compressor 10 is illustrated as including the discharge chamber 38, the present disclosure applies equally to direct discharge configurations. A discharge fitting 39 may be attached to the shell assembly 12 at an opening in the end cap 32. A suction-gas-inlet fitting (not shown) may be attached to the shell assembly 12 at another opening. The partition 34 may include a discharge passage 44 therethrough providing communication between the compression mechanism 18 and the discharge chamber 38.

The first bearing housing assembly 14 may be affixed to the shell 29 and may include a main bearing housing 46 and a first bearing 48 disposed therein. The main bearing housing 46 may house the bearing 48 therein and may define an annular flat thrust bearing surface 54 on an axial end surface thereof. The second bearing housing assembly 15 may be affixed to the shell 29 and may include a lower bearing housing 47 and a second bearing 49 disposed therein.

The motor assembly 16 may generally include a motor stator 58, a rotor 60, and a driveshaft 62. The motor stator 58 may be press fit into the shell 29. The driveshaft 62 may be rotatably driven by the rotor 60 and may be rotatably supported within the bearing 48. The rotor 60 may be press fit on the driveshaft 62. The driveshaft 62 may include an eccentric crankpin 64.

The compression mechanism 18 may include a first scroll (e.g., an orbiting scroll 68) and a second scroll (e.g., a non-orbiting scroll 70). The orbiting scroll 68 may include an end plate 72 having a spiral wrap 74 on the upper surface thereof and an annular flat thrust surface 76 on the lower surface. The thrust surface 76 may interface with the annular flat thrust bearing surface 54 on the main bearing housing 46. A cylindrical hub 78 may project downwardly from the thrust surface 76 and may have a drive bushing 80 rotatably disposed therein. The drive bushing 80 may include an inner bore in which the crank pin 64 is drivingly disposed. A flat surface of the crankpin 64 may drivingly engage a flat surface in a portion of the inner bore of the drive bushing 80 to provide a radially compliant driving arrangement. An Oldham coupling 82 may be engaged with the orbiting and non-orbiting scrolls 68, 70 or the orbiting scroll 68 and the main bearing housing 46 to prevent relative rotation therebetween.

The non-orbiting scroll 70 may include an end plate 84 defining a discharge passage 92 and having a spiral wrap 86 extending from a first side thereof. The non-orbiting scroll 70 may be attached to the bearing housing 46 via fasteners and sleeve guides that allow for a limited amount of axial movement of the non-orbiting scroll 70 relative to the orbiting scroll 68 and the bearing housing 46. The spiral wraps 74, 86 may be meshingly engaged with one another and define pockets 94, 96, 97, 98, 99, 100, 102, 104. It is understood that the pockets 94, 96, 98, 100, 102, 104 change throughout compressor operation.

A first pocket (pocket 94 in FIG. 1) may define a suction pocket in communication with a suction-pressure region 106 (e.g., a suction chamber defined by the shell 29 and partition 34) receiving suction-pressure working fluid from the suction-gas-inlet fitting) of the compressor 10 operating at a suction pressure. A second pocket (pocket 104 in FIG. 1) may define a discharge pocket in communication with a discharge pressure region (e.g., discharge chamber 38 receiving discharge-pressure working fluid from the compression mechanism 18) of the compressor 10 operating at a discharge pressure via the discharge passage 92. Pockets intermediate the first and second pockets (pockets 96, 97, 98, 99, 100, 102 in FIG. 1) may form intermediate compression pockets operating at intermediate pressures between the suction pressure and the discharge pressure.

Figure 2:
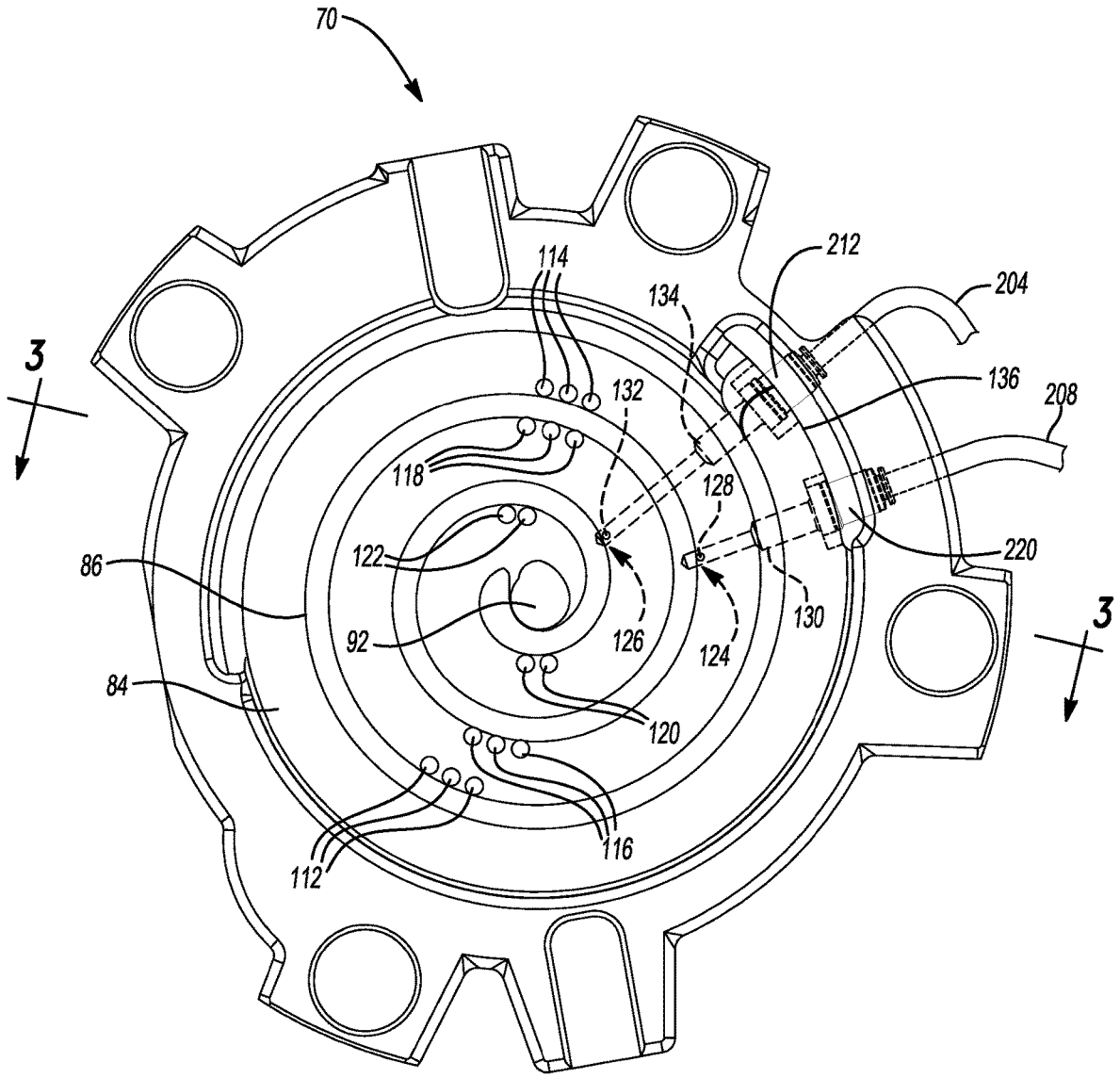
FIG. 2 is a bottom view of a non-orbiting scroll of the compressor of FIG. 1.
Figure 4:
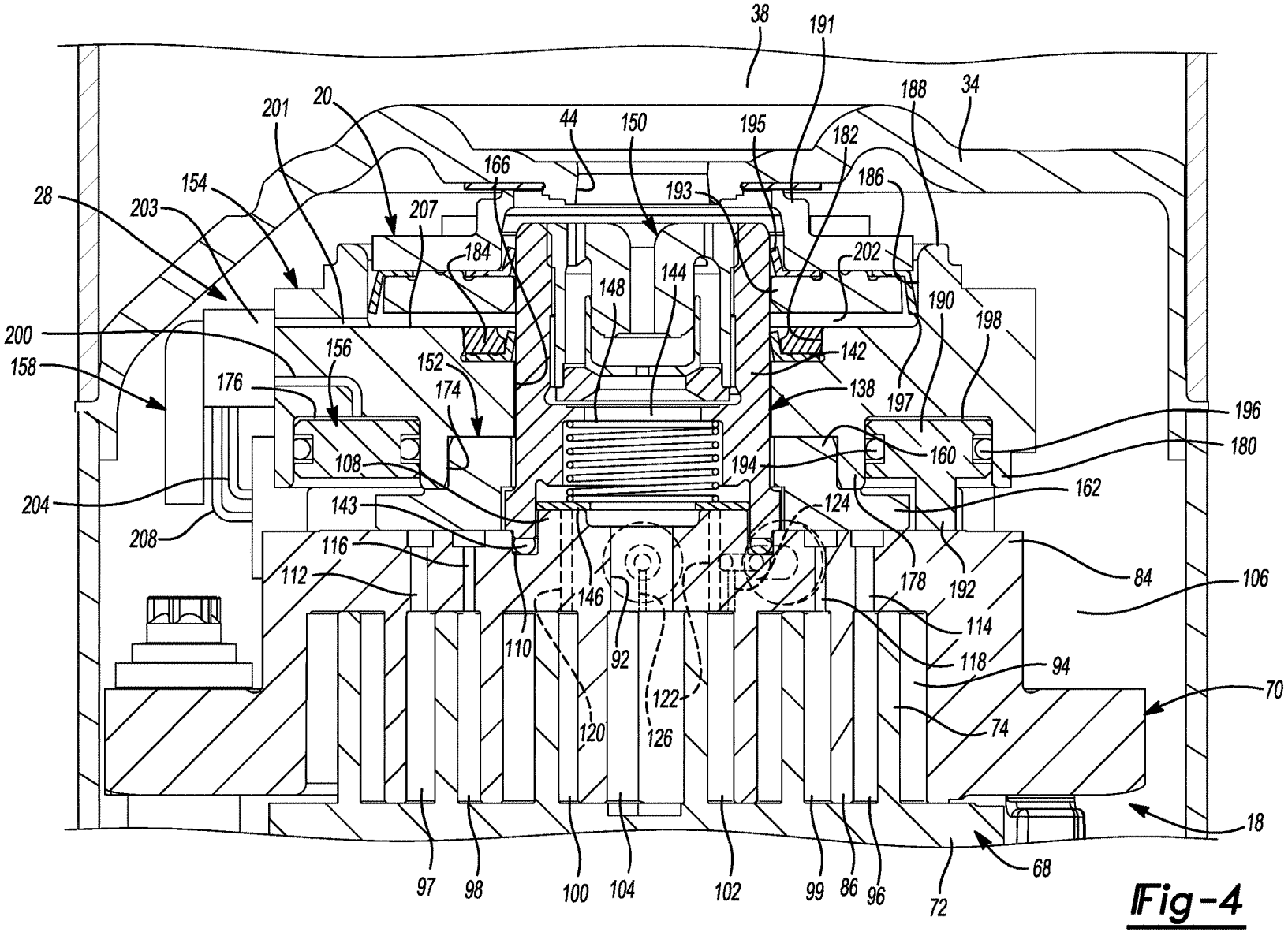
FIG. 4 is a cross-sectional view of a portion of the compressor in a full-capacity mode.
Figure 7:
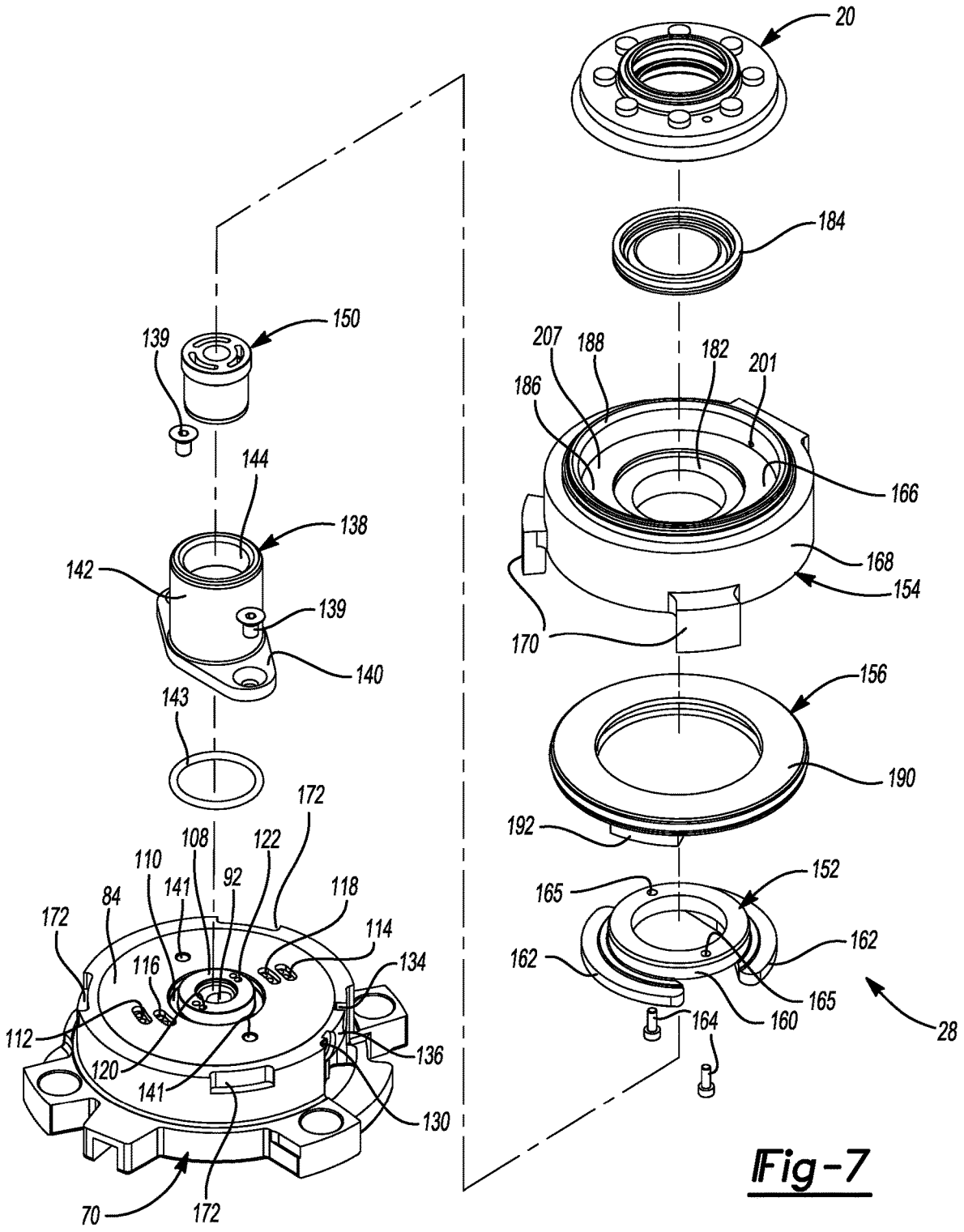
FIG. 7 is an exploded view of the non-orbiting scroll and capacity modulation assembly.
Figure 8:
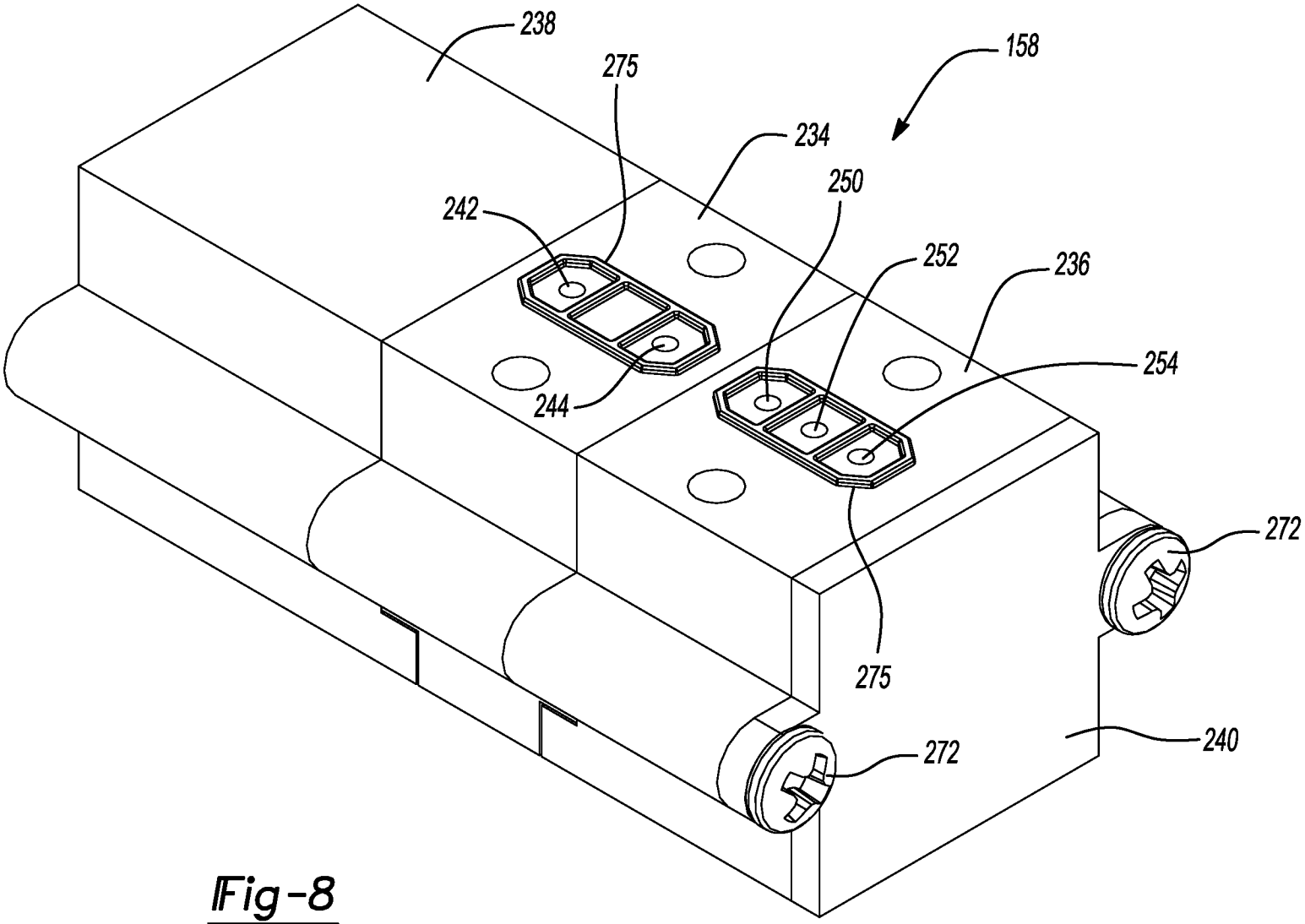
FIG. 8 is a perspective view of a modulation control valve of the compressor of FIG. 1.

As shown in FIG. 7, the end plate 84 of the non-orbiting scroll 70 may include a raised central boss 108 and an annular groove 110 encircling the central boss 108. The discharge passage 92 may extend through the central boss 108. As shown in FIGS. 2, 4, and 7, the end plate 84 may also include a plurality of modulation passages or ports (e.g., one or more first modulation ports 112, one or more second modulation ports 114, one or more third modulation ports 116, and one or more fourth modulation ports 118), one or more first variable-compression-ratio passages or ports 120, one or more second variable-compression-ratio passages or ports 122, an outer intermediate-cavity-pressure (ICP) passage or port 124, and an inner ICP passage or port 126. As shown in FIG. 4, the modulation ports 112, 114, 116, 118 may extend entirely through first and second opposing axially facing sides of the end plate 84 and are in selective fluid communication with respective intermediate pressure pockets (e.g., pockets 96, 97, 98, 99). The first and second modulation ports 112, 114 may be disposed radially outward relative to the third and fourth modulation ports 116, 118. The first and second variable-compression-ratio ports 120, 122 may be disposed radially inward relative to the third and fourth modulation ports 116, 118. As shown in FIG. 4, the first and second variable-compression-ratio ports 120, 122 may extend through the end plate 84 (e.g., through the first axially facing side of the end plate 84 and through the central boss 108. As shown in FIG. 4, the first and second variable-compression-ratio ports 120, 122 may be in selective fluid communication with respective intermediate pressure pockets (e.g., pockets 100, 102 disposed radially between pocket 104 and pockets 96, 97, 98, 99).

Figure 3:
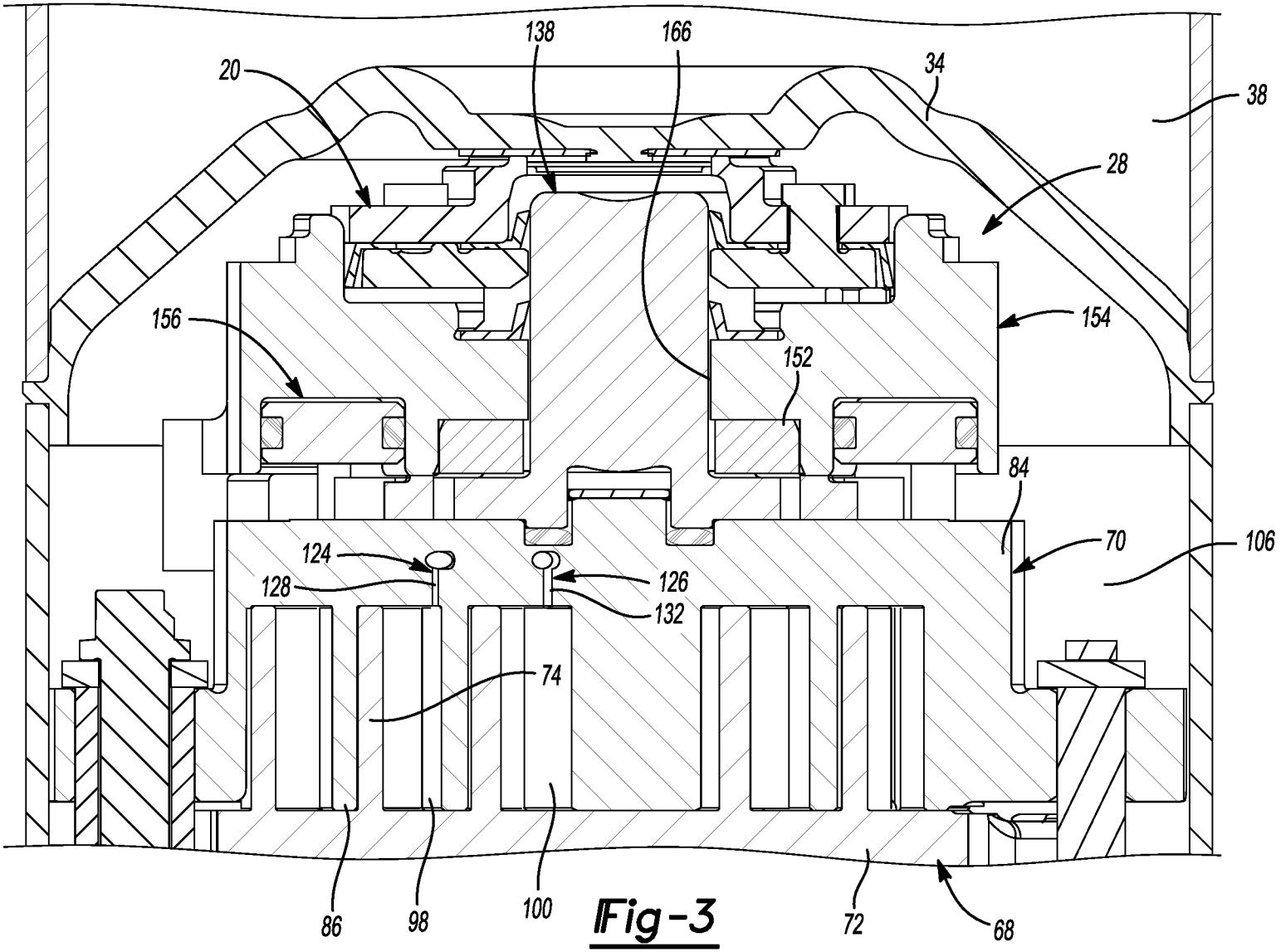
FIG. 3 is a partial cross-sectional view of the compressor taken along line 3-3 of FIG. 2.

As shown in FIG. 2, the outer ICP port 124 may include an axially extending portion 128 and a radially extending portion 130, and the inner ICP port 126 may include an axially extending portion 132 and a radially extending portion 134. As shown in FIG. 3, the axially extending portions 128, 132 of the ICP ports 124, 126 extend through the first axially facing side of the end plate 84 and extend only partially through the axial thickness of the end plate 84. As shown in FIG. 3, the axially extending portions 128, 132 are in selective fluid communication with respective intermediate pressure pockets (e.g., any of pockets 96, 97, 98, 99, 100, 102). The radially extending portions 130, 134 of the ICP ports 124, 126 extend radially from upper axial ends of the respective axially extending portions 128, 132 and through a radially peripheral surface 136 of the end plate 84, as shown in FIGS. 2 and 7.

As shown in FIG. 4, a hub 138 may be mounted to the second axially facing side of the end plate 84. The hub 138 may include a pair of feet or flange portions 140 (FIG. 7) and a cylindrical body portion 142 (FIGS. 4 and 7) extending axially from the flange portions 140. The hub 138 may be fixedly attached to the end plate 84 by fasteners 139 (FIG. 7) that extend through apertures in the flange portions 140 and into apertures 141 in the end plate 84. An annular seal 143 (FIGS. 4 and 7) is disposed in the annular groove 110 in the end plate 84 and sealingly engages the end plate 84 and the hub 138. A discharge passage 144 extends axially through the body portion 142 and is in fluid communication with the discharge chamber 38 via the discharge passage 44 in the partition 34. The discharge passage 144 is also in selective fluid communication with the discharge passage 92 in the end plate 84.

As shown in FIG. 4, a variable-compression-ratio valve 146 (e.g., an annular disk) may be disposed within the discharge passage 144 of the hub 138 and may be movable therein between a closed position and an open position. In the closed position (shown in FIG. 4), the variable-compression-ratio valve 146 contacts the central boss 108 of the end plate 84 to restrict or prevent fluid communication between the variable-compression-ratio ports 120, 122 and the discharge passages 144, 44. In the open position, the variable-compression-ratio valve 146 is spaced apart from the central boss 108 to allow fluid communication between the variable-compression-ratio ports 120, 122 and the discharge passages 144, 44. A spring 148 biases the variable-compression-ratio valve 146 toward the closed position. The variable-compression-ratio valve 146 is moved into the open position when the pressure of fluid within the compression pockets that are in communication with the variable-compression-ratio ports 120, 122 is higher than the pressure of fluid in the discharge chamber 38.

As shown in FIG. 4, a discharge valve assembly 150 may also be disposed within the discharge passage 144 of the hub 138. The discharge valve assembly 150 may be a one-way valve that allows fluid flow from the discharge passage 92 and/or variable-compression-ratio ports 120, 122 to the discharge chamber 38 and restricts or prevents fluid flow from the discharge chamber 38 back into the compression mechanism 18.

Figure 6:
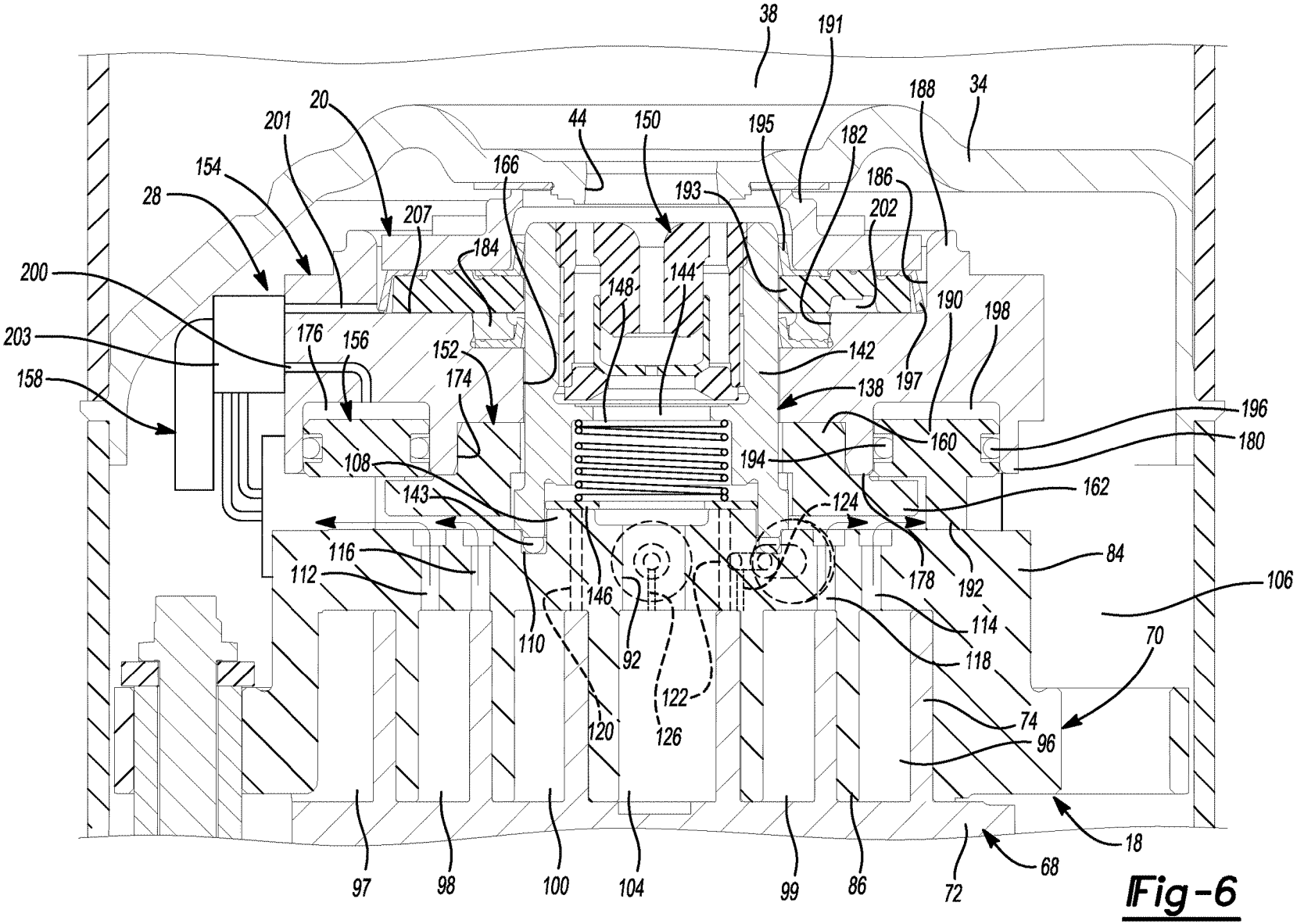
FIG. 6 is a cross-sectional view of a portion of the compressor in a reduced-capacity mode.

As shown in FIGS. 4 and 7, the capacity modulation assembly 28 may include a seal plate 152, a valve ring 154, a lift ring 156, and a modulation control valve 158 (a multi-way valve). As will be described in more detail below, the capacity modulation assembly 28 is operable to switch the compressor 10 between a first capacity mode (e.g., a full-capacity mode; FIG. 4) and a second capacity mode (e.g., a reduced-capacity mode; FIG. 6). In the full-capacity mode, fluid communication between the modulation ports 112, 114, 116, 118 and the suction-pressure region 106 is prevented. In the reduced-capacity mode, the modulation ports 112, 114, 116, 118 are allowed to fluidly communicate with the suction-pressure region 106 to vent intermediate-pressure working fluid from intermediate compression pockets (e.g., pockets 96, 97, 98, 99) to the suction-pressure region 106.

The seal plate 152 may include an annular ring 160 having a pair of flange portions 162 that extend axially downward and radially outward from the annular ring 160. As shown in FIG. 4, the seal plate 152 may encircle the cylindrical body portion 142 of the hub 138. That is, the body portion 142 may extend through the central aperture of the ring 160 of the seal plate 152. The flange portions 140 of the hub 138 may extend underneath the annular ring 160 (e.g., between the end plate 84 and the annular ring 160) and between the flange portions 162 of the seal plate 152. The seal plate 152 may be fixedly attached to the valve ring 154 (e.g., by fasteners 164 (FIG. 7) that extend through apertures 165 in the annular ring 160 and into the valve ring 154). The seal plate 152 may be considered a part of the valve ring 154 and/or the seal plate 152 may be integrally formed with the valve ring 154.

As will be described in more detail below, the seal plate 152 is movable with the valve ring 154 in an axial direction (i.e., a direction along or parallel to a rotational axis of the driveshaft 62) relative to the end plate 84 between a first position (FIG. 4) and a second position (FIG. 6). In the first position (FIG. 4), the flange portions 162 of the seal plate 152 contact the end plate 84 and close off the modulation ports 112, 114, 116, 118 to prevent fluid communication between the modulation ports 112, 114, 116, 118 and the suction-pressure region 106. In the second position (FIG. 6), the flange portions 162 of the seal plate 152 are spaced apart from the end plate 84 to open the modulation ports 112, 114, 116, 118 to allow fluid communication between the modulation ports 112, 114, 116, 118 and the suction-pressure region 106.

As shown in FIGS. 4 and 7, the valve ring 154 may be an annular body having a stepped central opening 166 extending therethrough and through which the hub 138 extends. In other words, the valve ring 154 encircles the cylindrical body portion 142 of the hub 138. As shown in FIG. 7, the valve ring 154 may include an outer peripheral surface 168 having a plurality of key features 170 (e.g., generally rectangular blocks) that extend radially outward and axially downward from the outer peripheral surface 168. The key features 170 may be slidably received in keyways 172 (e.g., generally rectangular recesses; shown in FIG. 7) formed in the outer periphery of the end plate 84. The key features 170 and keyways 172 allow for axial movement of the valve ring 154 relative to the non-orbiting scroll 70 while restricting or preventing rotation of the valve ring 154 relative to the non-orbiting scroll 70.

Figure 5:
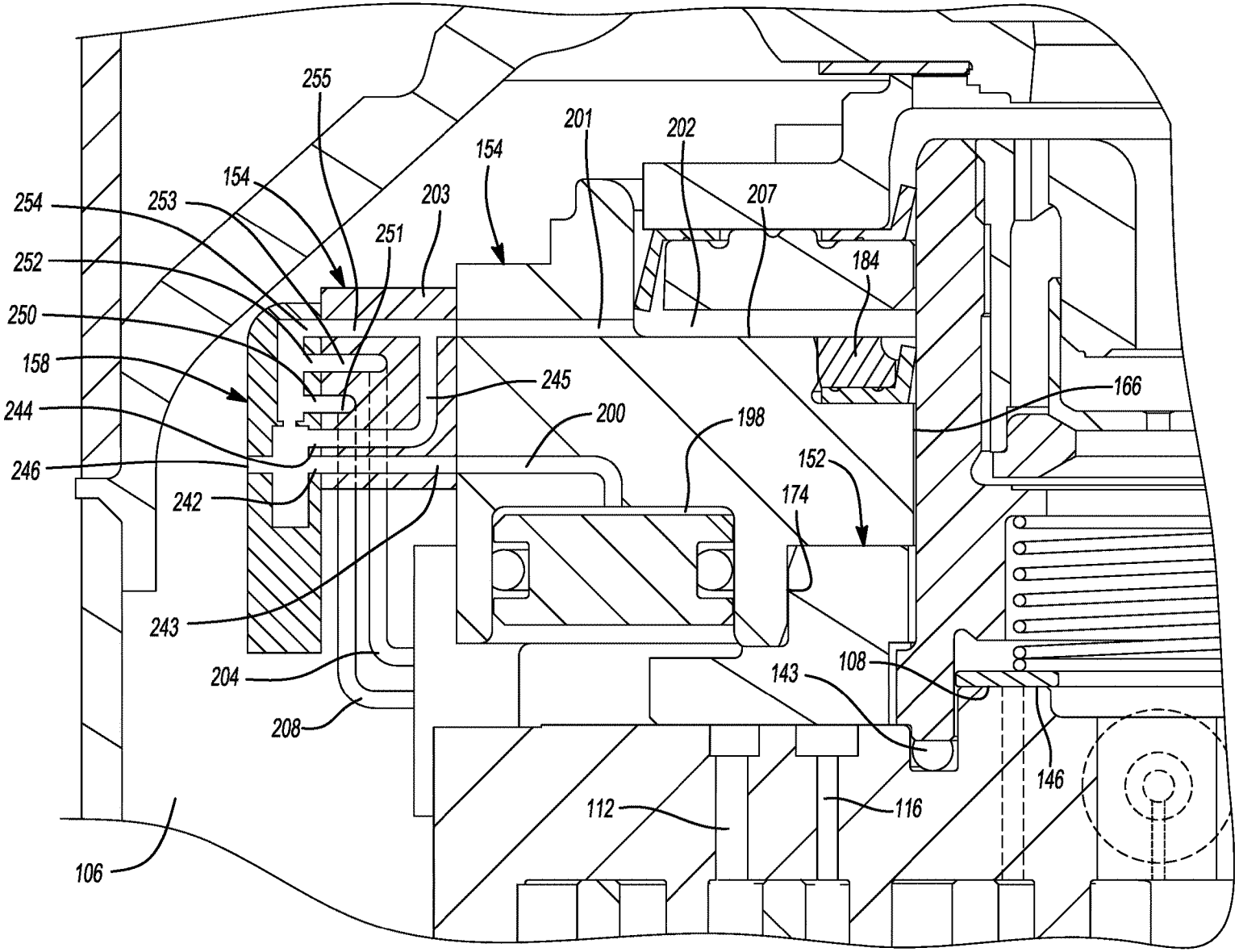
FIG. 5 is a partial cross-sectional view of a portion of the compressor in a full-capacity mode.

As shown in FIGS. 4-6, the central opening 166 of the valve ring 154 is defined by a plurality of steps in the valve ring 154 that form a plurality of annular recesses. For instance, a first annular recess 174 may be formed proximate a lower axial end of the valve ring 154 and may receive the ring 160 of the seal plate 152. A second annular recess 176 may encircle the first annular recess 174 and may be defined by inner and outer lower annular rims 178, 180 of the valve ring 154. The inner lower rim 178 separates the first and second annular recesses 174, 176 from each other. The lift ring 156 is partially received in the second annular recess 176. A third annular recess 182 is disposed axially above the first annular recess 174 and receives an annular seal 184 that sealingly engages the hub 138 and the valve ring 154. A fourth annular recess 186 may be disposed axially above the third annular recess 182 and may be defined by an axially upper rim 188 of the valve ring 154. The fourth annular recess 186 may receive a portion of the floating seal assembly 20.

As shown in FIGS. 4 and 7, the lift ring 156 may include an annular body 190 and a plurality of posts or protrusions 192 extending axially downward from the body 190. As shown in FIG. 4, the annular body 190 may be received within the second annular recess 176 of the valve ring 154. The annular body 190 may include inner and outer annular seals (e.g., O-rings) 194, 196. The inner annular seal 194 may sealingly engage an inner diametrical surface of the annular body 190 and the inner lower rim 178 of the valve ring 154. The outer annular seal 196 may sealingly engage an outer diametrical surface of the annular body 190 and the outer lower rim 180 of the valve ring 154. The protrusions 192 may contact the end plate 84 and axially separate the annular body 190 from the end plate 84. The lift ring 156 remains stationary relative to the end plate 84 while the valve ring 154 and the seal plate 152 move axially relative to the end plate 84 between the first and second positions (see FIGS. 4 and 6).

As shown in FIGS. 4-6, the annular body 190 of the lift ring 156 may cooperate with the valve ring 154 to define a modulation control chamber 198. That is, the modulation control chamber 198 is defined by and disposed axially between opposing axially facing surfaces of the annular body 190 and the valve ring 154. The valve ring 154 includes a first control passage 200 that extends from the modulation control chamber 198 to a manifold 203 fluidly coupled with the modulation control valve 158. The first control passage 200 fluidly communicates with the modulation control chamber 198 and the modulation control valve 158 (via the manifold 203).

As shown in FIGS. 4-7, the floating seal assembly 20 may be an annular member encircling the hub 138. For example, the floating seal assembly 20 may include first and second disks 191, 193 that are fixed to each other and annular lip seals 195, 197 that extend from the disks 191, 193. The floating seal assembly 20 may be sealingly engaged with the partition 34, the hub 138, and the valve ring 154. In this manner, the floating seal assembly 20 fluidly separates the suction-pressure region 106 from the discharge chamber 38. In some configurations, the floating seal assembly 20 could be a one-piece floating seal.

During steady-state operation of the compressor 10, the floating seal assembly 20 may be a stationary component. The floating seal assembly 20 is partially received in the fourth annular recess 186 of the valve ring 154 and cooperates with the hub 138, the annular seal 184 and the valve ring 154 to define an axial biasing chamber 202 (FIGS. 4-6). The axial biasing chamber 202 is axially between and defined by the floating seal assembly 20 and an axially facing surface 207 of the valve ring 154. The valve ring 154 includes a second control passage 201 that extends from the axial biasing chamber 202 to the manifold 203. The second control passage 201 fluidly communicates with the axial biasing chamber 202 and the modulation control valve 158 (via the manifold 203).

The axial biasing chamber 202 is in selective fluid communication with one of the outer and inner ICP ports 124, 126 (FIGS. 2 and 3). That is, the inner ICP port 126 is in selective fluid communication with the axial biasing chamber 202 during the reduced-capacity mode (FIG. 6) via a first tube 204, the manifold 203, the modulation control valve 158, and the first control passage 200. The outer ICP port 124 is in selective fluid communication with the axial biasing chamber 202 during the full-capacity mode (FIG. 4) via a second tube 208, the manifold 203, the modulation control valve 158, and the first control passage 200. Intermediate-pressure working fluid in the axial biasing chamber 202 (supplied by one of the ICP ports 124, 126) biases the non-orbiting scroll 70 in an axial direction (a direction along or parallel to the rotational axis of the driveshaft 62) toward the orbiting scroll 68 to provide proper axial sealing between the scrolls 68, 70 (i.e., sealing between tips of the spiral wrap 74 of the orbiting scroll 68 against the end plate 84 of the non-orbiting scroll 70 and sealing between tips of the spiral wrap 86 of the non-orbiting scroll 70 against the end plate 72 of the orbiting scroll 68).

As shown in FIG. 2, the radially extending portion 134 of the inner ICP port 126 may be fluidly coupled with a first fitting 212 that is fixedly attached to the end plate 84. The first fitting 212 may be fluidly coupled with the first tube 204. The first tube 204 may extend partially around the outer peripheries of the end plate 84 and the valve ring 154 and is fluidly coupled with the manifold 203 (FIGS. 4-6). The first tube 204 may be flexible and/or stretchable to allow for movement of the valve ring 154 relative to the non-orbiting scroll 70.

As shown in FIG. 2, the radially extending portion 130 of the outer ICP port 124 may be fluidly coupled with a second fitting 220 that is fixedly attached to the end plate 84. The second fitting 220 may be fluidly coupled with the second tube 208. The second tube 208 may extend partially around the outer peripheries of the end plate 84 and the valve ring 154 and is fluidly coupled with the manifold 203 (FIGS. 4-6). The second tube 208 may be flexible and/or stretchable to allow for movement of the valve ring 154 relative to the non-orbiting scroll 70.

The modulation control valve 158 may be a solenoid-operated multi-way valve and may be in fluid communication with the suction-pressure region 106, the first and second control passages 200, 201, and the ICP ports 124, 126 (via tubes 208, 204) via the manifold 203. During operation of the compressor 10, the modulation control valve 158 may be operable to switch the compressor 10 between a first mode (e.g., the full-capacity mode) and a second mode (e.g., the reduced-capacity mode). FIGS. 4-6 schematically depict the modulation control valve 158. FIGS. 8-14 depict the modulation control valve 158 in more detail.

When the compressor 10 is in the full-capacity mode (FIG. 4), the modulation control valve 158 may provide fluid communication between the modulation control chamber 198 and the suction-pressure region 106 via the first control passage 200, thereby lowering the fluid pressure within the modulation control chamber 198 to suction pressure. With the fluid pressure within the modulation control chamber 198 at or near suction pressure, the relatively higher fluid pressure within the axial biasing chamber 202 (e.g., an intermediate pressure) will force the valve ring 154 and seal plate 152 axially downward relative to the end plate 84 (i.e., away from the floating seal assembly 20) such that the seal plate 152 is in contact with the end plate 84 and closes the modulation ports 112, 114, 116, 118 (i.e., to prevent fluid communication between the modulation ports 112, 114, 116, 118 and the suction-pressure region 106), as shown in FIG. 4.

When the compressor 10 is in the reduced-capacity mode (FIG. 6), the modulation control valve 158 may provide fluid communication between the modulation control chamber 198 and the axial biasing chamber 202 via the first and second control passages 200, 201, thereby raising the fluid pressure within the modulation control chamber 198 to the same or similar intermediate pressure as the axial biasing chamber 202. With the fluid pressure within the modulation control chamber 198 at the same intermediate pressure as the axial biasing chamber 202, the fluid pressure within the modulation control chamber 198 and the fluid pressure in the modulation ports 112, 114, 116, 118 will force the valve ring 154 and seal plate 152 axially upward relative to the end plate 84 (i.e., toward the floating seal assembly 20) such that the seal plate 152 is spaced apart from the end plate 84 to open the modulation ports 112, 114, 116, 118 (i.e., to allow fluid communication between the modulation ports 112, 114, 116, 118 and the suction-pressure region 106), as shown in FIG. 6.

Accordingly, the axial biasing chamber 202 receives working fluid from the outer ICP port 124 when the compressor 10 is operating in the full-capacity mode, and the axial biasing chamber 202 receives working fluid from the inner ICP port 126 when the compressor 10 is operating in the reduced-capacity mode. As shown in FIG. 3, the inner ICP port 126 may be open to (i.e., in direct fluid communication with) one of the compression pockets (such as one of the intermediate-pressure pockets 98, 100, for example) that is radially inward relative to the compression pocket to which the outer ICP port 124 is open (i.e., the compression pocket with which the outer ICP port 124 is in direct fluid communication). Therefore, for any given set of operating conditions, the compression pocket to which the inner ICP port 126 is open may be at a higher pressure than the compression pocket to which the outer ICP port 124 is open.

By switching which one of the ICP ports 124, 126 supplies working fluid to the axial biasing chamber 202 when the compressor 10 is switched between the full-capacity and reduced-capacity modes, the capacity modulation assembly 28 of the present disclosure can supply working fluid of a more preferred pressure to the axial biasing chamber 202 in both the full-capacity and reduced-capacity modes. That is, while the pressure of the working fluid supplied by the outer ICP port 124 may be appropriate while the compressor is in the full-capacity mode, the pressure of the working fluid at the outer ICP port 124 is lower during the reduced-capacity mode (due to venting of working fluid to the suction-pressure region 106 through modulation ports 112, 114, 116, 118 during the reduced-capacity mode) than it is during the full-capacity mode. To compensate for that reduction in fluid pressure, the modulation control valve 158 directs working fluid from the inner ICP port 126 to the axial biasing chamber 202 during the reduced-capacity mode. During operation in the full-capacity mode, the modulation control valve 158 directs working fluid from the outer ICP port 124 to the axial biasing chamber 202. In this manner, working fluid of an appropriately high pressure can be supplied to the axial biasing chamber 202 during the reduced-capacity mode to adequately bias the non-orbiting scroll 70 axially toward the orbiting scroll 68 to ensure appropriate sealing between the tips of spiral wraps 74, 86 and end plates 84, 72, respectively.

Supplying working fluid to the axial biasing chamber 202 from the outer ICP port 124 (rather than from the inner ICP port 126) in the full-capacity mode ensures that the pressure of working fluid in the axial biasing chamber 202 is not too high in the full-capacity mode, which ensures that the scrolls 70, 68 are not over-clamped against each other. Over-clamping the scrolls 70, 68 against each other (i.e., biasing the non-orbiting scroll 70 axially toward the orbiting scroll 68 with too much force) would introduce an unduly high friction load between the scrolls 68, 70, which would result in increased wear, increased power consumption and efficiency losses. Therefore, the operation of the modulation control valve 158 described above minimizes wear and improves efficiency of the compressor 10 in the full-capacity and reduced-capacity modes.

Figure 10:
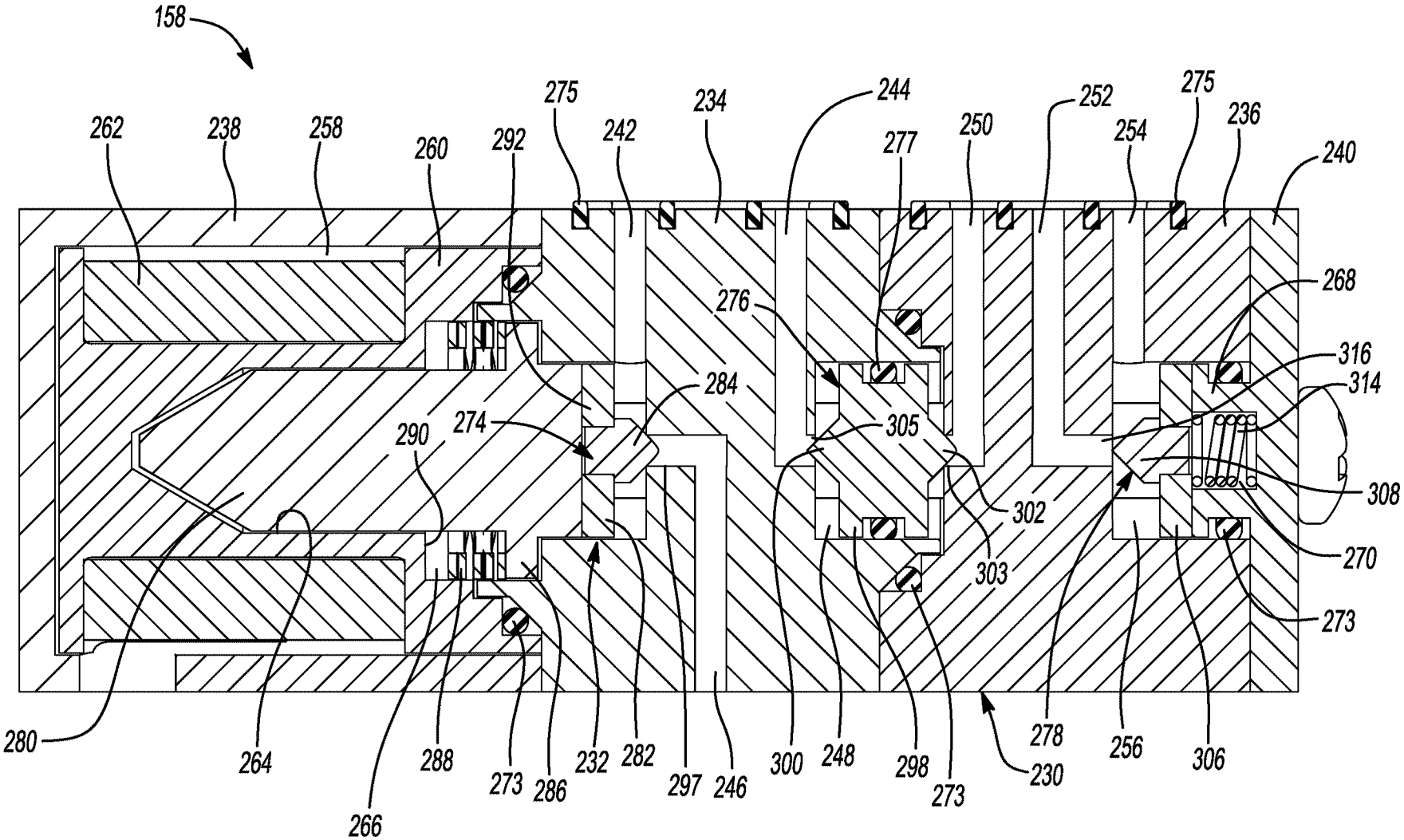
FIG. 10 is a cross-sectional view of the modulation control valve in a first position.
Figure 11:
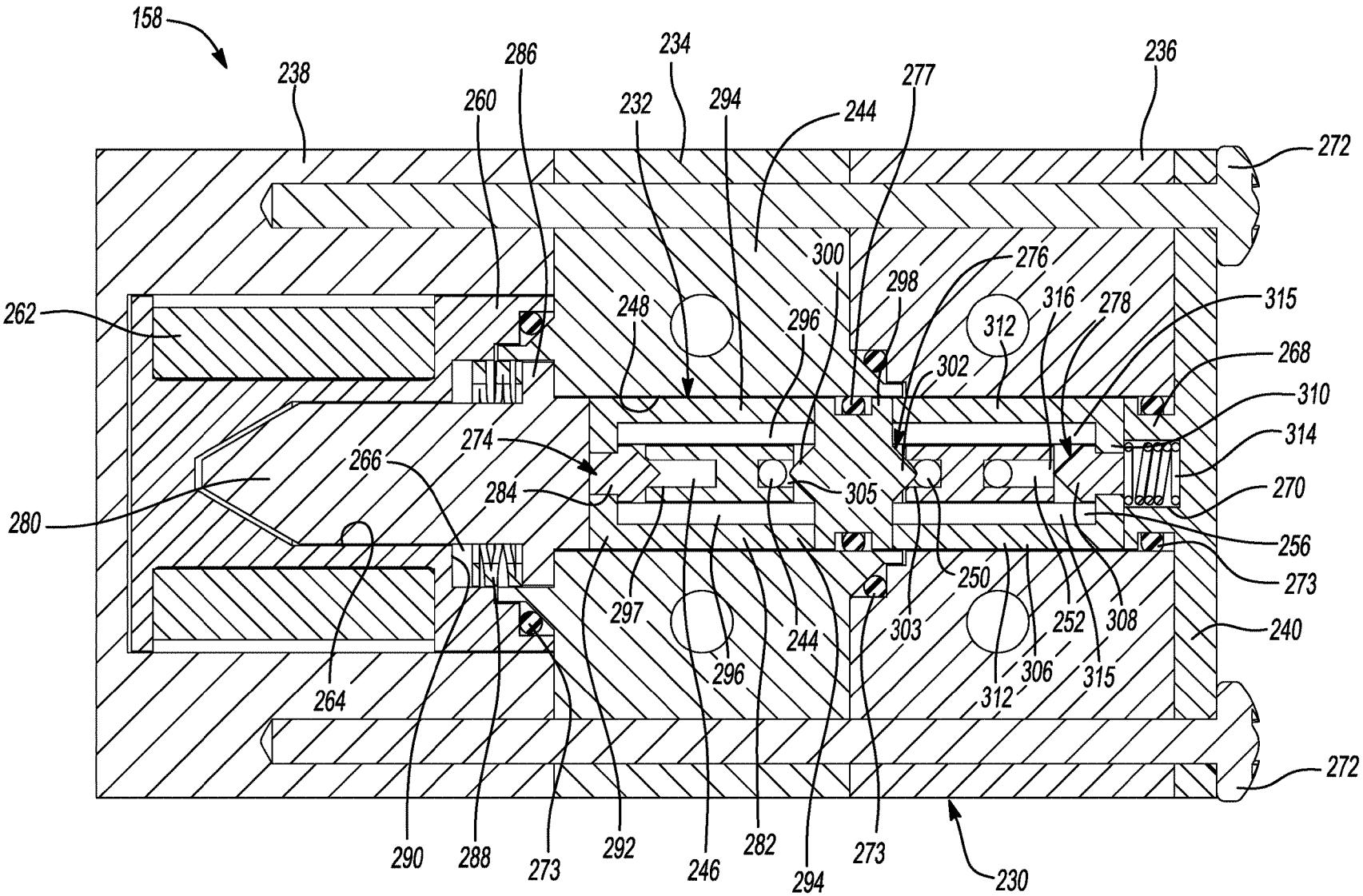
FIG. 11 is another cross-sectional view of the modulation control valve in the first position.
Figure 12:
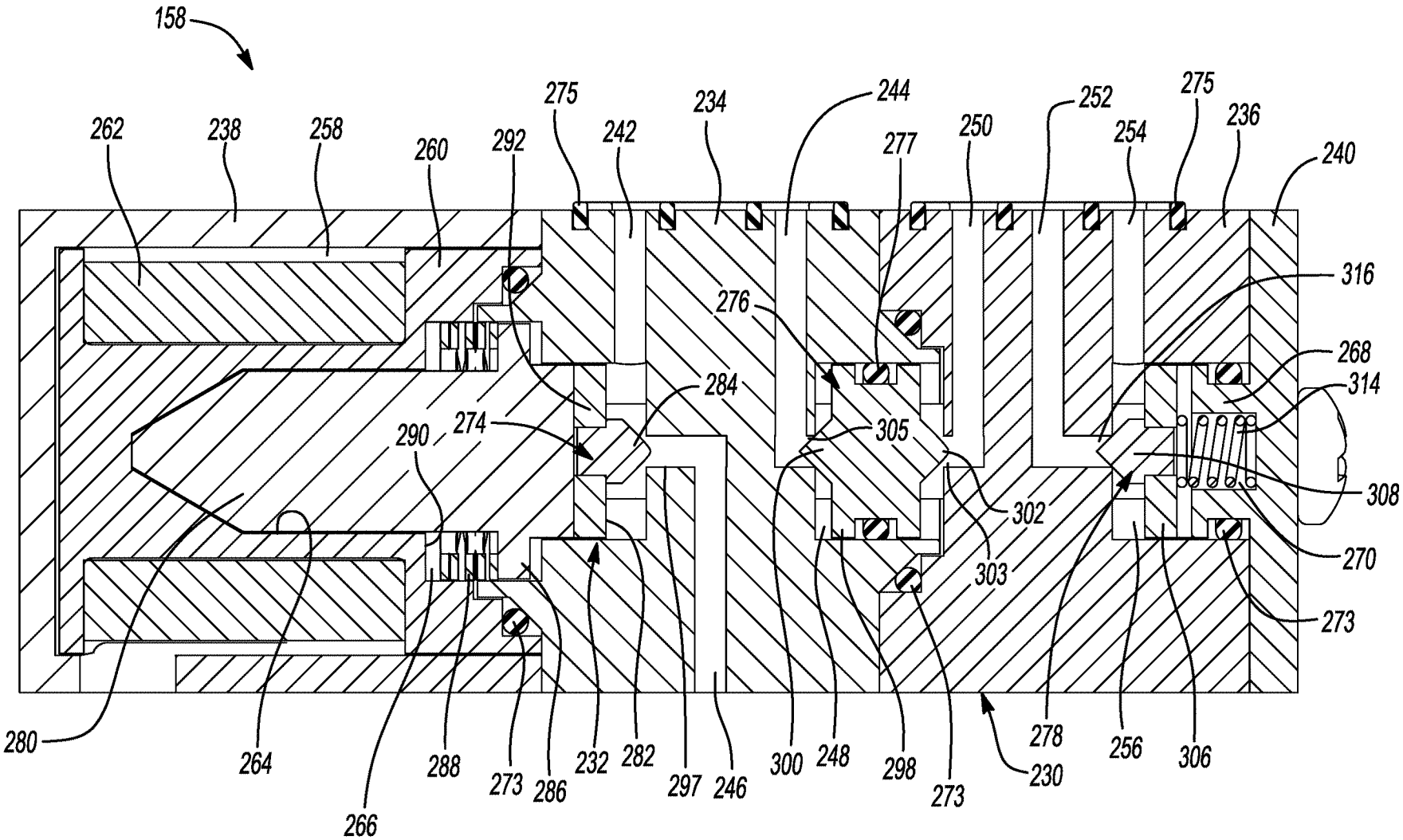
FIG. 12 is a cross-sectional view of the modulation control valve in a second position.
Figure 13:
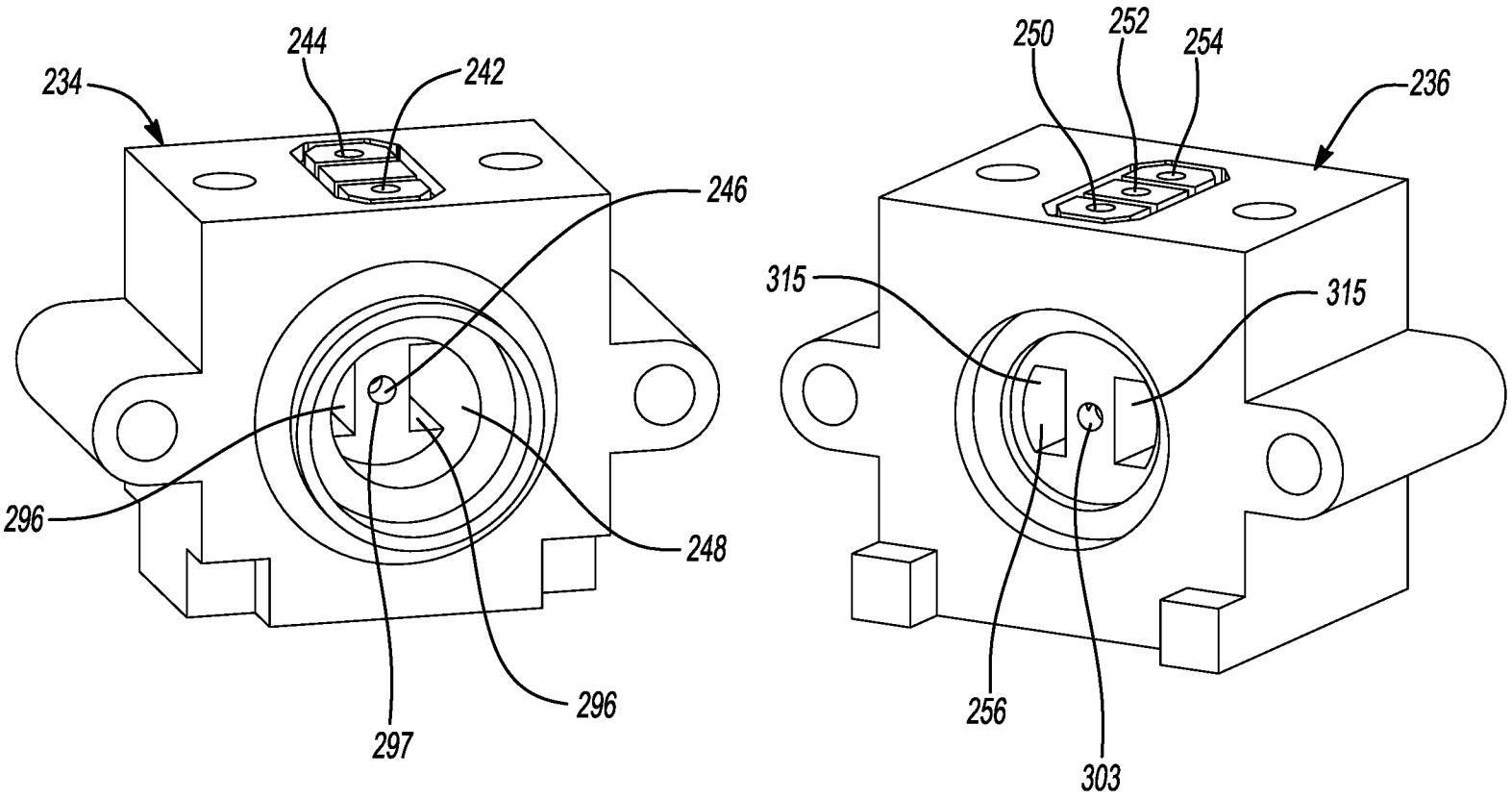
FIG. 13 is an exploded view of first and second body portions of a valve body of the modulation control valve.
Figure 14:
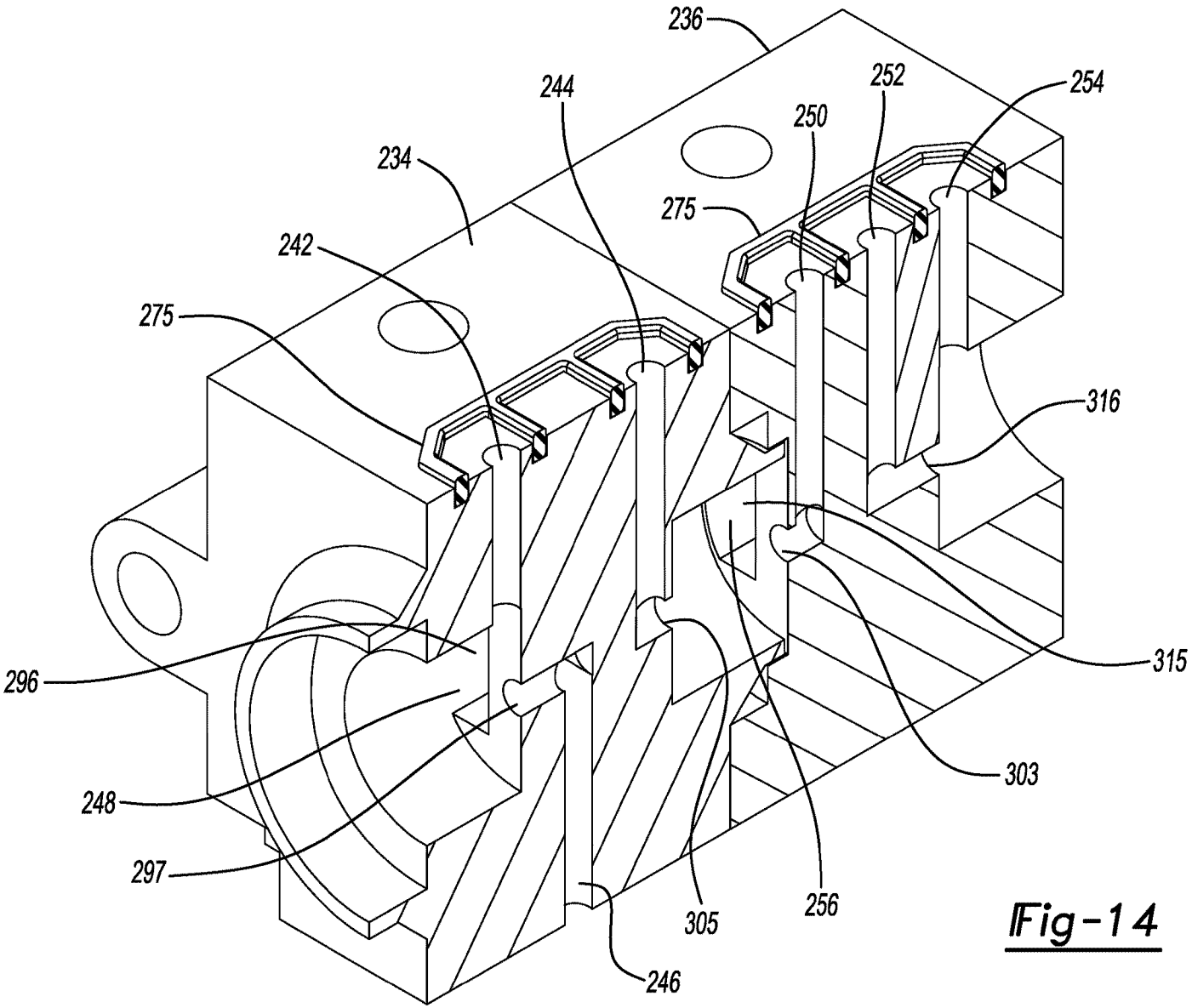
FIG. 14 is a perspective cross-sectional view of the first and second body portions of the valve body of the modulation control valve.

Referring now to FIGS. 8-14, the modulation control valve 158 will be described in detail. The modulation control valve 158 may include a valve body 230 and a valve member 232 that is movable relative to the valve body 230 between a first position (FIGS. 10 and 11) and a second position (FIG. 12). As will be described in more detail below, movement of the valve member 232 into the first position switches the compressor 10 into the reduced-capacity mode (FIG. 6) and allows fluid communication between the inner ICP port 126 and the axial biasing chamber 202 while preventing fluid communication between the outer ICP port 124 and the axial biasing chamber 202. Movement of the valve member 232 into the second position switches the compressor 10 into the full-capacity mode (FIG. 4) and allows fluid communication between the outer ICP port 124 and the axial biasing chamber 202 while preventing fluid communication between the inner ICP port 126 and the axial biasing chamber 202.

The valve body 230 may include a first body portion 234, a second body portion 236, a solenoid housing 238, and an end plate 240. The first body portion 234 may include a first port 242, a second port 244, a third port 246, and a first central cavity 248 that fluidly communicates with the ports 242, 244, 246. The first port 242 may be fluidly coupled with the modulation control chamber 198 (via port 243 of the manifold 203 and the first control passage 200, as shown in FIG. 5). The second port 244 may be fluidly coupled with the axial biasing chamber 202 (via port 245 of the manifold 203 and the second control passage 201, as shown in FIG. 5). The third port 246 may be open to the suction-pressure region 106 (as shown in FIG. 5).

The second body portion 236 of the valve body 230 may include a fourth port 250, a fifth port 252, a sixth port 254, and a second central cavity 256 that fluidly communicates with the ports 250, 252, 254. The fourth port 250 may be fluidly coupled with the outer ICP port 124 (via port 251 of the manifold 203 and the second tube 208, as shown in FIG. 5). The fifth port 252 may be fluidly coupled with the inner ICP port 126 (via port 253 of the manifold 203 and the first tube 204, as shown in FIG. 5). The sixth port 254 may be fluidly coupled with the axial biasing chamber 202 (via port 255 of the manifold 203 and the second control passage 201, as shown in FIG. 5). The first and second body portions 233, 236 may engage each other.

The solenoid housing 238 may include a cavity 258 that receives a solenoid spool 260 and a solenoid coil 262 that is wound around the spool 260. The spool 260 includes a pocket 264 and a recess 266 disposed around the pocket 264. The solenoid housing 238 may engage the first body portion 234.

The end plate 240 may include a hub 268 having a spring pocket 270. The end plate 240 may engage the second body portion 236. Fasteners (e.g., threaded fasteners) 272 may be received in apertures in the first body portion 234, the second body portion 236, the solenoid housing 238, and the end plate 240 and may threadably engage the apertures in the solenoid housing 238 to secure the first body portion 234, the second body portion 236, the solenoid housing 238, and the end plate 240 to each other. O-rings 273 (and/or gaskets or other seals) may be provided to seal the connections between the first body portion 234, the second body portion 236, the solenoid housing 238, and the end plate 240. Gaskets 275 may be mounted to the first and second body portions 234, 236 to seal the fluid connections between the manifold 203 and the first and second body portions 234, 236.

The valve member 232 may include a first plunger 274, a second plunger 276, and a third plunger 278. The first plunger 274 may include a solenoid piston 280, a first strut 282, and a first plug 284. The piston 280, first strut 282, and first plug 284 may be fixed relative to each other (i.e., movable with each other) when the modulation control valve 158 is in a fully assembled condition. The piston 280 is reciprocatingly received in the pocket 264 of the solenoid spool 260. The piston 280 may include a flange 286. A spring 288 may be disposed around the piston 280 and axially between the flange 286 and a ledge 290 (which defines the recess 266) of the solenoid spool 260. The spring 288 biases the valve member 232 toward the first position (FIGS. 10 and 11).

Figure 9:
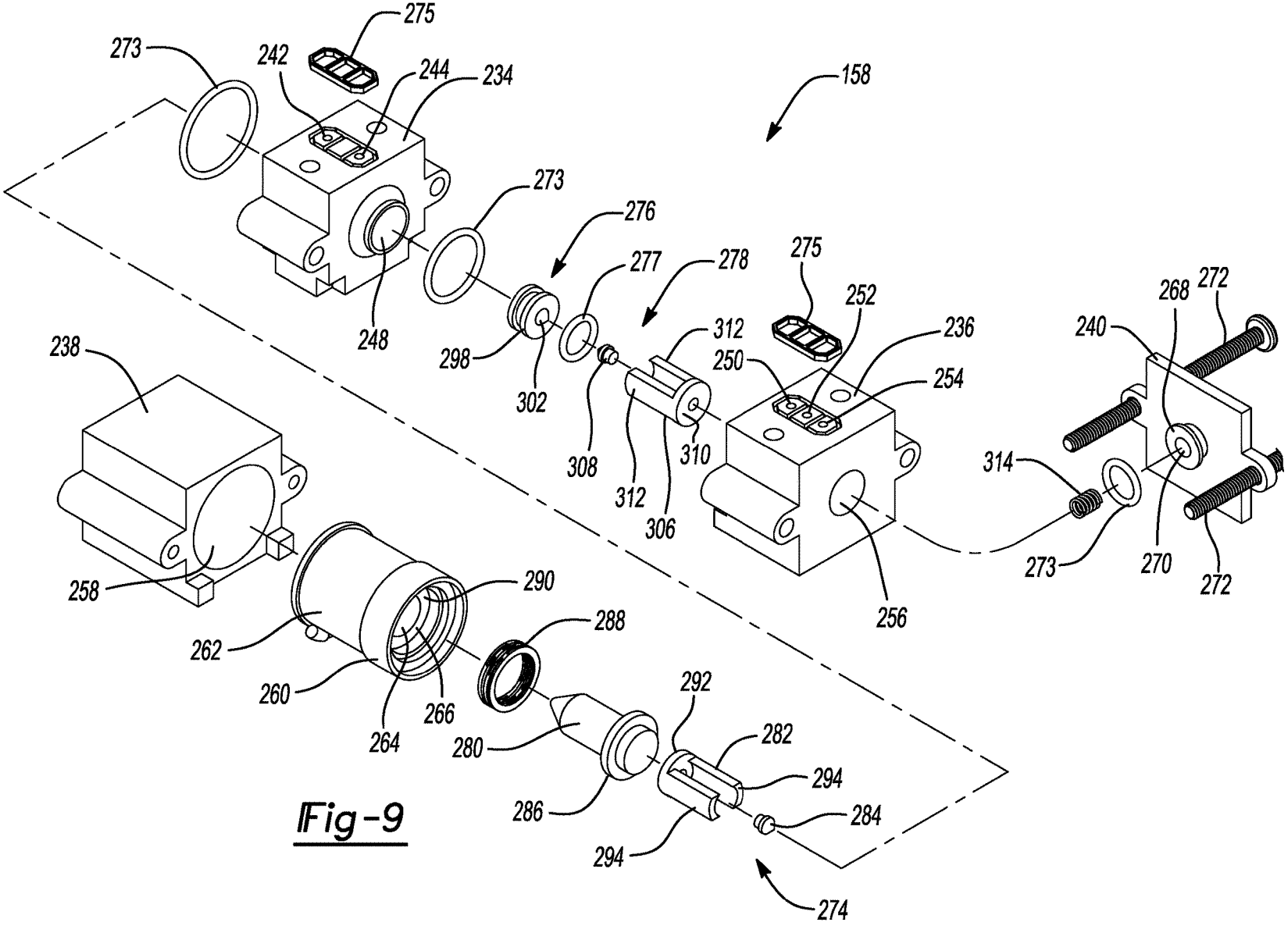
FIG. 9 is an exploded view of the modulation control valve.

As shown in FIG. 9, the first strut 282 may include a disc portion 292 and a pair of legs 294. The disc portion 292 may be fixedly attached to the solenoid piston 280. The legs 294 extend outward from the disc portion 292 away from the piston 280. The legs 294 are slidably received in channels 296 (FIGS. 11 and 13) of the first cavity 248. The first plug 284 may be disposed between the legs 294 and may extend from the disc portion 292 away from the solenoid piston 280. The first plug 284 may have a conically shaped portion that can selectively plug the third port 246.

When the valve member 232 is in the first position (FIGS. 10 and 11), the first plug 284 may plug or close off an end 297 of the third port 246, thereby preventing fluid communication between the first cavity 248 and the third port 246 (thereby preventing the first and second ports 242, 244 from fluidly communicating with the third port 246, which prevents the modulation control chamber 198 and the axial biasing chamber 202 from fluidly communicating with the suction-pressure region 106). When the valve member 232 is in the second position (FIG. 12), the first plug 284 may unplug or open the end 297 of the third port 246, thereby allowing fluid communication between the first cavity 248 and the third port 246 (thereby allowing the first port 242 to fluidly communicate with the third port 246, which allows the modulation control chamber 198 to fluidly communicate with the suction-pressure region 106).

The second plunger 276 of the valve member 232 may include a disc-shaped body 298 having a second plug 300 and a third plug 302 extending axially from the body 298 in opposite directions. The second and third plugs 300, 302 can be conically shaped, for example. The second plunger 276 may fluidly separate the first cavity 248 of the valve body 230 from the second cavity 256 of the valve body 230 (e.g., a seal 277 may sealingly engage the second plunger 276 and the first body portion 234). When the valve member 232 is in the first position (FIGS. 10 and 11), the third plug 302 may plug or close off an end 303 of the fourth port 250, thereby preventing fluid communication between the second cavity 256 and the fourth port 250 (thereby preventing the fifth and sixth ports 252, 254 from fluidly communicating with the fourth port 250, which prevents the outer ICP port 124 from fluidly communicating with the inner ICP port 126 and the axial biasing chamber 202). Furthermore, when the valve member 232 is in the first position (FIGS. 10 and 11), the second plug 300 is unplugged from or leaves open an end 305 of the second port 244, thereby allowing fluid communication between the second port 244 and the first cavity 248 (thereby allowing fluid communication between the first and second ports 242, 244, which allows the modulation control chamber 198 to fluidly communicate with the axial biasing chamber 202).

When the valve member 232 is in the second position (FIG. 12), the second plug 300 plugs or closes off the end 305 of the second port 244, thereby preventing fluid communication between the second port 244 and the first cavity 248 (thereby preventing the second port 244 from fluidly communicating with the first and third ports 242, 246, which prevents the axial biasing chamber from fluidly communicating with the modulation control chamber 198 and the suction-pressure region 106). Furthermore, when the valve member 232 is in the second position (FIG. 12), the third plug 302 is unplugged from or opens the end 303 of the fourth port 250, thereby allowing fluid communication between the second cavity 256 and the fourth port 250 (thereby allowing the sixth port 254 to fluidly communicate with the fourth port 250, which allows the outer ICP port 124 to fluidly communicate with the axial biasing chamber 202).

The third plunger 278 of the valve member 232 may include a second strut 306, and a fourth plug 308. As shown in FIG. 9, the second strut 306 may include a disc portion 310 and a pair of legs 312. A spring 314 disposed within the spring pocket 270 may contact the disc portion 310 and may bias the valve member 232 toward the second position. The legs 312 extend outward from the disc portion 310 away from the spring 314. The legs 312 are slidably received in channels 315 (FIGS. 11 and 13) of the second cavity 256. The legs 312 of the second strut 306 and the legs 294 of the first strut 282 may abut the body 298 of the second plunger 276 (i.e., the body 298 is sandwiched between the legs 294 and the legs 312, as shown in FIG. 11). In this manner, the first, second, and third plungers 274, 276, 278 all move together relative to the valve body 230 between the first and second positions.

The fourth plug 308 may be disposed between the legs 312 and may extend from the disc portion 310 away from the spring 314. The fourth plug 308 may have a conically shaped portion that can selectively plug the fifth port 252. When the valve member 232 is in the first position (FIGS. 10 and 11), the fourth plug 308 is unplugged from or opens the end 316 of the fifth port 252, thereby allowing fluid communication between the fifth port 252 and the second cavity 256 (thereby allowing fluid communication between the fifth and sixth ports 252, 254, which allows fluid communication between the inner ICP port 126 and the axial biasing chamber 202). When the valve member 232 is in the second position (FIG. 12), the fourth plug 308 plugs or closes off the end 316 of the fifth port 252, thereby preventing the fifth port 252 from fluidly communicating with the second cavity 256 (thereby preventing the fifth port 252 from fluidly communicating with the fourth and six ports 250, 254, which prevents the inner ICP port 126 from fluidly communicating with the axial biasing chamber 202 or the outer ICP port 124.

The solenoid coil 262 can be energized to move the valve member 232 into the second position (FIG. 12) (i.e., energizing the solenoid coil 262 compresses the spring 288, which allows the spring 314 to move the plungers 274, 276, 278 into the second position) to switch the compressor 10 into the full-capacity mode (FIG. 4) and allow fluid communication between the outer ICP port 124 and the axial biasing chamber 202 while preventing fluid communication between the inner ICP port 126 and the axial biasing chamber 202. That is, when the valve member 232 is in the second position, the modulation control chamber 198 is allowed to fluidly communicate with the suction-pressure region 106 (e.g., via the first control passage 200 (FIG. 5), port 243 of the manifold 203 (FIG. 5), the first port 242 of the valve body 230, and the third port 246 of the valve body 230. This causes fluid pressure within the modulation control chamber 198 to drop down to suction pressure, which allows the valve ring 154 and seal plate 152 to block modulation ports 112, 114, 116, 118 (as shown in FIGS. 4 and 5).

De-energizing the solenoid coil 262 causes movement of the valve member 232 into the first position (FIGS. 10 and 11) (i.e., de-energizing the solenoid coil 262 allows the spring 288 to overcome the force of the spring 314 and move the plungers 274, 276, 278 into the first position) to switch the compressor 10 into the reduced-capacity mode (FIG. 6) and allow fluid communication between the inner ICP port 126 and the axial biasing chamber 202 while preventing fluid communication between the outer ICP port 124 and the axial biasing chamber 202. That is, when the valve member 232 is in the first position, the modulation control chamber 198 is allowed to fluidly communicate with the axial biasing chamber 202 (e.g., via the first control passage 200 (FIG. 5), port 243 of the manifold 203 (FIG. 5), the first port 242 of the valve body 230, the second port 244 of the valve body 230, port 245 of the manifold 203, and second control passage 201. This causes fluid pressure within the modulation control chamber 198 to rise down to the same intermediate pressure as the axial biasing chamber 202, which allows the valve ring 154 and seal plate 152 to move upward to open the modulation ports 112, 114, 116, 118 (as shown in FIG. 6).

While the modulation control valve 158 is described above as being a solenoid-actuated valve, it will be appreciated that other types of actuators (e.g., other electromechanical actuators, pneumatic actuators, hydraulic actuators, or working-fluid-powered actuators, for example) could be used to move the valve member 232 between the first and second positions.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shell assembly;

a first scroll disposed within the shell assembly and including a first end plate and a first spiral wrap extending from the first end plate;

a second scroll disposed within the shell assembly and including a second end plate and a second spiral wrap extending from the second end plate, the first and second spiral wraps meshing with each other and forming a plurality of compression pockets therebetween, wherein the compression pockets include a suction-pressure compression pocket, a discharge-pressure compression pocket at a higher pressure than the suction-pressure compression pocket, and a plurality of intermediate-pressure compression pockets at respective pressures between the pressures of the suction and discharge compression pockets, wherein the second end plate includes an outer port and an inner port, wherein the outer port is disposed radially outward relative to the inner port, wherein the outer port is configured to receive working fluid from a first one of the intermediate-pressure compression pockets, and wherein the inner port is configured to receive working fluid from a second one of the intermediate-pressure compression pockets;

an axial biasing chamber disposed within the shell assembly, wherein working fluid disposed within the axial biasing chamber axially biases one of the first and second scrolls toward the other of the first and second scrolls; and a control valve in fluid communication with the inner port, the outer port, and the axial biasing chamber, wherein:

the control valve is movable between a first position and a second position, movement of the control valve into the first position switches the compressor into a reduced-capacity mode and allows fluid communication between the inner port and the axial biasing chamber while preventing fluid communication between the outer port and the axial biasing chamber, movement of the control valve into the second position switches the compressor into a full-capacity mode and allows fluid communication between the outer port and the axial biasing chamber while preventing fluid communication between the inner port and the axial biasing chamber, and the control valve includes a valve body and a valve member movable relative to the valve body between the first and second positions, and wherein the valve body includes a first port, a second port, a third port, a fourth port, a fifth port, and a sixth port.

2. The compressor of claim 1, wherein the second end plate includes one or more modulation ports in fluid communication with one or more of the intermediate-pressure compression pockets, wherein movement of the control valve into the first position allows fluid flow through the one or more modulation ports, and wherein movement of the control valve into the second position prevents fluid flow through the one or more modulation ports.

3. The compressor of claim 2, further comprising a valve ring movable relative to the second end plate between a first position in which the valve ring is spaced apart from the second end plate to allow fluid flow through the one or more modulation ports and a second position in which the valve ring blocks fluid flow through the one or more modulation ports.

4. The compressor of claim 1, wherein the control valve is in fluid communication with a modulation control chamber.

5. The compressor of claim 4, wherein movement of the control valve into the first position allows fluid communication between the modulation control chamber and the axial biasing chamber via the control valve, and wherein movement of the control valve into the second position allows fluid communication between the modulation control chamber and a suction-pressure region of the compressor.

6. The compressor of claim 1, wherein the first scroll is an orbiting scroll, and wherein the second scroll is a non-orbiting scroll.

7. The compressor of claim 1, wherein the valve body includes a first cavity and a second cavity that are fluidly separated from each other, wherein the first cavity is fluidly connected with the first, second, and third ports, and wherein the second cavity is fluidly connected with the fourth, fifth, and sixth ports.

8. The compressor of claim 7, wherein when the valve member is in the first position:

the first and second ports are in fluid communication with the first cavity, fluid communication between the third port and the first cavity is prevented, fluid communication between the fourth port and the second cavity is prevented, and the fifth and sixth ports are in fluid communication with the second cavity.

9. The compressor of claim 8, wherein when the valve member is in the second position:

the first and third ports are in fluid communication with the first cavity, fluid communication between the second port and the first cavity is prevented, fluid communication between the fifth port and the second cavity is prevented, and the fourth and sixth ports are in fluid communication with the second cavity.

10. The compressor of claim 9, wherein:

the first port is fluidly connected with a modulation control chamber defined by a valve ring that opens modulation ports in the second end plate when the valve member is in the first position, the second port is fluidly connected with the axial biasing chamber, the third port is fluidly connected with a suction-pressure region of the compressor, the fourth port is fluidly connected with the outer port, the fifth port is fluidly connected with the inner port, and the sixth port is fluidly connected with the axial biasing chamber.

11. The compressor of claim 10, wherein:

the valve member includes a first plug, a second plug, a third plug, and a fourth plug, the first, second, third, and fourth plugs are movable together between the first and second positions, the first plug closes an end of the third port in the first position and opens the end of the third port in the second position, the second plug opens an end of the second port in the first position and closes the end of the second port in the second position, the third plug closes an end of the fourth port in the first position and opens the end of the fourth port in the second position, and the fourth plug opens an end of the fifth port in the first position and closes the end of the fifth port in the second position.

12. A compressor comprising:

a shell assembly;

a first scroll disposed within the shell assembly and including a first end plate and a first spiral wrap extending from the first end plate;

a second scroll disposed within the shell assembly and including a second end plate and a second spiral wrap extending from the second end plate, the first and second spiral wraps meshing with each other and forming a plurality of compression pockets therebetween, wherein the compression pockets include a suction-pressure compression pocket, a discharge-pressure compression pocket at a higher pressure than the suction-pressure compression pocket, and a plurality of intermediate-pressure compression pockets at respective pressures between the pressures of the suction and discharge compression pockets, wherein the second end plate includes an outer port and an inner port, wherein the outer port is disposed radially outward relative to the inner port, wherein the outer port is configured to receive working fluid from a first one of the intermediate-pressure compression pockets, and wherein the inner port is configured to receive working fluid from a second one of the intermediate-pressure compression pockets;

an axial biasing chamber disposed within the shell assembly, wherein working fluid disposed within the axial biasing chamber axially biases one of the first and second scrolls toward the other of the first and second scrolls; and a control valve in fluid communication with the inner port, the outer port, and the axial biasing chamber, wherein:

the control valve is movable between a first position and a second position, movement of the control valve into the first position allows fluid communication between the inner port and the axial biasing chamber while preventing fluid communication between the outer port and the axial biasing chamber, movement of the control valve into the second position allows fluid communication between the outer port and the axial biasing chamber while preventing fluid communication between the inner port and the axial biasing chamber, and the control valve includes a valve body and a valve member movable relative to the valve body between the first and second positions, and wherein the valve body includes a first port, a second port, a third port, a fourth port, a fifth port, and a sixth port.

13. The compressor of claim 12, wherein:

the valve member includes a first plug, a second plug, a third plug, and a fourth plug, the first, second, third, and fourth plugs are movable together between the first and second positions, the first plug closes an end of the third port in the first position and opens the end of the third port in the second position, the second plug opens an end of the second port in the first position and closes the end of the second port in the second position, the third plug closes an end of the fourth port in the first position and opens the end of the fourth port in the second position, and the fourth plug opens an end of the fifth port in the first position and closes the end of the fifth port in the second position.

14. The compressor of claim 12, wherein the valve body includes a first cavity and a second cavity that are fluidly separated from each other, wherein the first cavity is fluidly connected with the first, second, and third ports, and wherein the second cavity is fluidly connected with the fourth, fifth, and sixth ports.

15. The compressor of claim 14, wherein when the valve member is in the first position:

the first and second ports are in fluid communication with the first cavity, fluid communication between the third port and the first cavity is prevented, fluid communication between the fourth port and the second cavity is prevented, and the fifth and sixth ports are in fluid communication with the second cavity.

16. The compressor of claim 14, wherein when the valve member is in the second position:

the first and third ports are in fluid communication with the first cavity, fluid communication between the second port and the first cavity is prevented, fluid communication between the fifth port and the second cavity is prevented, and the fourth and sixth ports are in fluid communication with the second cavity.

17. The compressor of claim 12, wherein:

the first port is fluidly connected with a modulation control chamber, the second port is fluidly connected with the axial biasing chamber, the third port is fluidly connected with a suction-pressure region of the compressor, the fourth port is fluidly connected with the outer port, the fifth port is fluidly connected with the inner port, and the sixth port is fluidly connected with the axial biasing chamber.

18. The compressor of claim 17, wherein the modulation control chamber is defined by a valve ring that is configured to selectively open a modulation port in the second end plate.

19. A compressor comprising:

a shell assembly;

a first scroll disposed within the shell assembly and including a first end plate and a first spiral wrap extending from the first end plate;

a second scroll disposed within the shell assembly and including a second end plate and a second spiral wrap extending from the second end plate, the first and second spiral wraps meshing with each other and forming a plurality of compression pockets therebetween;

an axial biasing chamber disposed within the shell assembly, wherein working fluid disposed within the axial biasing chamber axially biases one of the first and second scrolls toward the other of the first and second scrolls; and a control valve in fluid communication with the axial biasing chamber, wherein:

the control valve includes a valve body and a valve member movable relative to the valve body between a first position and a second position, the valve body includes a first port, a second port, a third port, a fourth port, a fifth port, and a sixth port, the valve member includes a first plug, a second plug, a third plug, and a fourth plug, the first, second, third, and fourth plugs are movable together between the first and second positions, the first plug closes an end of the third port in the first position and opens the end of the third port in the second position, the second plug opens an end of the second port in the first position and closes the end of the second port in the second position, the third plug closes an end of the fourth port in the first position and opens the end of the fourth port in the second position, the fourth plug opens an end of the fifth port in the first position and closes the end of the fifth port in the second position, and the valve body includes a first cavity and a second cavity that are fluidly separated from each other, wherein the first cavity is fluidly connected with the first, second, and third ports, and wherein the second cavity is fluidly connected with the fourth, fifth, and sixth ports.

20. The compressor of claim 19, wherein when the valve member is in the first position:

the first and second ports are in fluid communication with the first cavity, fluid communication between the third port and the first cavity is prevented, fluid communication between the fourth port and the second cavity is prevented, and the fifth and sixth ports are in fluid communication with the second cavity.

21. The compressor of claim 20, wherein when the valve member is in the second position:

the first and third ports are in fluid communication with the first cavity, fluid communication between the second port and the first cavity is prevented, fluid communication between the fifth port and the second cavity is prevented, and the fourth and sixth ports are in fluid communication with the second cavity.

22. The compressor of claim 21, wherein:

the first port is fluidly connected with a modulation control chamber, the second port is fluidly connected with the axial biasing chamber, the third port is fluidly connected with a suction-pressure region of the compressor, the fourth port is fluidly connected with a first intermediate-pressure compression pocket that is at a pressure higher than a suction pressure of the compressor and lower than a discharge pressure of the compressor, the fifth port is fluidly connected with a second intermediate-pressure compression pocket that is disposed radially inward relative to the first intermediate-pressure compression pocket, and the sixth port is fluidly connected with the axial biasing chamber.

* * * * *